US008506190B2

(12) United States Patent
Kohira

(10) Patent No.: US 8,506,190 B2
(45) Date of Patent: Aug. 13, 2013

(54) CUTTER MECHANISM AND PRINTER WITH A CUTTER

(75) Inventor: Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 215 days.

(21) Appl. No.: 12/804,724

(22) Filed: Jul. 28, 2010

(65) Prior Publication Data

US 2011/0026999 A1 Feb. 3, 2011

(30) Foreign Application Priority Data

Jul. 29, 2009 (JP) ..... 2009-176800

(51) Int. Cl.
*B41J 11/70* (2006.01)
*B41J 11/66* (2006.01)
*B26D 1/08* (2006.01)

(52) U.S. Cl.
USPC ..... 400/621; 101/93.07; 83/564

(58) Field of Classification Search
USPC ..... 83/563, 564, 583, 636; 101/93.07
IPC ..... B41J 11/66, 11/70; B26D 1/08
See application file for complete search history.

(56) References Cited

U.S. PATENT DOCUMENTS 6,155,731 A * 12/2000 Bertalan et al. ..... 400/621
7,059,793 B2 * 6/2006 Mori et al. ..... 400/621
7,547,153 B2 * 6/2009 Yoshioka ..... 400/621
7,547,154 B2 * 6/2009 Kawaguchi ..... 400/621

FOREIGN PATENT DOCUMENTS

JP 2001347485 12/2001
JP 2005059395 A * 3/2005

* cited by examiner

*Primary Examiner* — Daniel J Colilla
*Assistant Examiner* — John M Royston
(74) *Attorney, Agent, or Firm* — Adams & Wilks

(57) ABSTRACT

A cutter mechanism has a fixed blade and slidable blade which cooperates with the fixed blade to cut a recording sheet. The fixed blade is biased in a direction away from a base portion by a biasing member. A holder supports the fixed blade away from the base portion to cause a cutting edge of the fixed blade to swing up and down and permit opposite ends of the fixed blade to be pushed down at least in the direction of the base portion. The fixed blade holder has a wall portion positioning the fixed blade in a sliding direction of the slidable blade, a first regulating member that regulates lifting of the fixed blade cutting edge, and a second regulating member that regulates lifting of the fixed blade root portion in a state in which a gap is formed between the base portion and the root portion.

18 Claims, 21 Drawing Sheets

CUTTER MECHANISM AND PRINTER WITH A CUTTER

BACKGROUND OF THE INVENTION

1. Field of the Invention

The present invention relates to a cutter mechanism that cuts a recording sheet while sandwiching the recording sheet by causing a movable blade to slide with respect to a fixed blade, and to a printer with a cutter including the cutter mechanism.

2. Description of the Related Art

Nowadays, a great number of various types of thermal printers, which performs printing by pressing a thermal head against a special recording sheet that changes color when heat is applied thereto, are provided. In particular, use is suitably made in printing of receipts, tickets, and the like because smooth character printing and colorful graphic printing are possible without using toner, ink, and the like.

As represented by the thermal printers, numerous printers with a cutter provided with a cutter mechanism for cutting the printed recording sheet are known. The printer with a cutter is used by being incorporated in, for example, a cash register, a mobile terminal device, and the like.

Typically, the cutter mechanism is configured by a fixed blade and a movable blade that is slidable. When cutting the recording sheet, the movable blade is slid so as to ride on the upper surface or the lower surface of the fixed blade. Both blades are then allowed to sandwich and cut the recording sheet as if a pair of scissors.

In general, the fixed blade is configured to have the cutting edge side supported so as to be swingable up and down, and is biased so that the cutting edge is pushed upward by a biasing portion such as a coil spring with respect to the movable blade. Thus, when the movable blade slides, both blades are brought into contact with each other at an appropriate contacting pressure. As a result, such design is made so that the recording sheet can be cut neatly.

Further, the movable blade is typically formed into a substantially V-shape in top view, and is designed so as to come into contact with the fixed blade at right and left two points when riding on the fixed blade. Therefore, in accordance with slidable movement of the movable blade, the right and left two contact points move along a width direction of the recording sheet from both sides toward a middle of the recording sheet. Thus, it is possible to sharply cut the recording sheet from both right and left sides thereof without skew.

However, in order to sharply cut the recording sheet from both right and left sides toward the middle thereof, it is necessary to equally subject the fixed blade and the movable blade to press-contact at the right and left two contact points. If a difference is seen between press-contact forces, there is a fear that an uncut portion, etc. are left, or a fear that a cut end surface is distorted.

In this context, as a cutting device meeting such need, there is known a cutting device capable of performing correction so that a press-contact force of the fixed blade with respect to the movable blade is equalized in a blade width direction (see Japanese Patent No. 3801423).

The cutting device is briefly described. First, on a root portion side of the fixed blade (on an opposite side of the cutting edge), two or more projecting support portions are formed. Meanwhile, in a fixed blade holding member for holding the fixed blade, receiving holes into which the support portions are inserted are formed according to the number of the support portions. The receiving holes are formed to have a size larger than that of the support portions in order to secure plays between the inserted support portions and the receiving holes.

Further, the fixed blade is held by the fixed blade holding member in a state in which the support portions are swingably inserted in the receiving holes. In this case, the fixed blade is biased by a plate spring, and the cutting edge side is pressed against the movable blade.

With this configuration, when the movable blade rides on the fixed blade, due to a biasing force applied by the plate spring, the fixed blade and the movable blade are held in press-contact with each other at an appropriate contacting pressure. In this case, the plays are secured between the support portions and the receiving holes, and hence the fixed blade can slightly swing in the blade width direction. Therefore, even if a difference is seen between the press-contact forces at the right and left two contact points, the fixed blade swings in the blade width direction, and it is possible to perform correction so that the press-contact forces are equalized.

However, because the two or more support portions inserted in the receiving holes are formed on the fixed blade, it has been difficult to expect a high swinging property in the blade width direction. In other words, with use of the plays secured between the support portions and the receiving holes, the fixed blade can be caused to swing in the blade width direction. However, because the two or more support portions are formed, it is difficult to make the most of each of the plays, and a swinging amount is necessarily restricted.

Therefore, the high swinging property in the blade width direction cannot be expected, and it has been sometimes difficult to equalize the press-contact forces at the right and left two contact points during cutting from beginning to end. Consequently, there remains a fear that an uncut portion, etc are still left when the recording sheet is cut.

Further, though the fixed blade is typically manufactured by punching with use of a die, a die shape is complex because two or more support portions are formed. In particular, as a material for the fixed blade, a metal material with high hardness is often adopted, and hence a high load tends to act on the die during punching. Therefore, as the die shape becomes more complex and fine, chips and cracks are more likely to occur, and the life of the die is more likely to decrease. As a result, a manufacturing cost of the fixed blade is influenced, which leads to an increase in the cost of the fixed blade. In view of the foregoing, a fixed blade having a simple a shape as possible is presently desired.

SUMMARY OF THE INVENTION

The present invention has been made in view of the above-mentioned circumstances, and an object of the present invention is therefore to provide a cutter mechanism capable of achieving a high swinging property of the fixed blade, reliably cutting the recording sheet from both right and left sides thereof without leaving an uncut portion, etc., and achieving simplification of a shape of the fixed blade and cost reduction.

Further, another object of the present invention is to provide a printer with a cutter including the cutter mechanism.

In order to solve the above-mentioned problems, the present invention provides the following techniques.

(1) A cutter mechanism for cutting a recording sheet, includes: a fixed blade formed into a plate shape, including two parallel sides, one of the two parallel sides serving as a cutting edge, another one of the two parallel sides serving as a root portion; a fixed blade holder for holding the fixed blade at a position away from a base portion so as to cause the cutting edge to swing up and down about the root portion; a movable blade formed into a substantially V-shape in top view, the movable blade being arranged to be slidable with respect to the fixed blade, and riding on the fixed blade during sliding to cut the recording sheet while sandwiching the recording sheet with the fixed blade; and a biasing member fixed on the base portion, for biasing the fixed blade in a direction of moving away from the base portion, in which the fixed blade holder includes: a wall portion provided to protrude on the base portion, for positioning the fixed blade in a sliding direction of the movable blade by coming into contact with the root portion; a first regulating member for regulating lifting of the cutting edge of the biased fixed blade; and a second regulating member for regulating lifting of the root portion of the biased fixed blade in a state in which a predetermined gap is formed between the base portion and the root portion.

In the cutter mechanism according to the present invention, the fixed blade is held at the position away from the base portion of the fixed blade holder in a state in which the cutting edge can swing up and down about the root portion. That is, the fixed blade is biased by the biasing member in the direction of moving away from the base portion in a state in which the root portion is held in contact with the wall portion. In this case, the first regulating member regulates the lifting of the cutting edge, and the second regulating member regulates the lifting of the root portion. When a force against the biasing member acts on the fixed blade, the fixed blade can swing up and down about the root portion so that the cutting edge moves along an arc trace.

Further, the predetermined gap is formed between the base portion and the root portion, and hence, with use of the gap, the fixed blade can swing freely in the blade width direction with a high degree of freedom.

Incidentally, when the recording sheet is cut, the movable blade is slidably moved with respect to the fixed blade. Then, the movable blade is on top of the fixed blade while riding thereon, and sandwiches and cuts the recording sheet with the fixed blade. In this case, the movable blade is formed into a substantially V-shape in top view, and hence the movable blade comes into contact with the fixed blade at right and left two points. Thus, in accordance with the slidable movement of the movable blade, it is possible to cut the recording sheet from both right and left sides toward a middle thereof, and to sharply cut the recording sheet without skew.

Further, when the movable blade rides on the fixed blade, the fixed blade is likely to be pushed back toward the base portion. However, as described above, the fixed blade is biased by the biasing member. Therefore, the fixed blade and the movable blade can be held in contact with each other at an appropriate contacting pressure. Accordingly, a gap is hardly formed between the cutting edge of the fixed blade and the movable blade, and hence it is possible to cut the recording sheet with a sharp cutting edge.

In addition, unlike a conventional fixed blade restricted in a swinging property in the blade width direction, the fixed blade can swing in the blade width direction with a high degree of freedom while using the predetermined gap secured between the base portion and the root portion. Thus, the fixed blade swings freely in the blade width direction according to circumstances during cutting from beginning to end, and the press-contact forces at the right and left two contact points can be always equalized. Therefore, it is possible to reliably and entirely cut the recording sheet from the both right and left sides thereof without leaving an uncut portion, etc. As a result, a cutter mechanism with high quality and improved cutting reliability can be obtained.

Moreover, unlike a conventional fixed blade required to be provided with a projection-like support portion, the fixed blade can be a simple plate-shaped fixed blade with a flat root portion. Therefore, simplification of the shape of the fixed blade can be achieved. In addition, a reduction in manufacturing cost of a die used to manufacture the fixed blade, a reduction in frequency of maintenance, and long lifetime of the die can be achieved. Accordingly, the above-mentioned achievement can contribute to a reduction in cost of the fixed blade and the cutter mechanism.

(2) In the cutter mechanism according the present invention, on the base portion, a protruding portion is formed, the protruding portion coming into contact with the root portion at a substantially middle in a blade width direction of the fixed blade to sandwich the root portion with the second regulating member, and allowing the fixed blade to swing in the blade width direction with a portion held in contact with the protruding portion acting as a fulcrum.

In the cutter mechanism according to the present invention, the fixed blade is sandwiched between the protruding portion and the second regulating member, and hence it is possible to prevent the entire fixed blade from escaping toward the base portion when the movable blade rides on the fixed blade. Therefore, the cutting edge of the fixed blade can be brought into press-contact with the movable blade more reliably, and a cutting property can be further increased.

Moreover, the fixed blade is allowed to swing like a seesaw in the blade width direction with the portion held in contact with the protruding portion acting as a fulcrum. Accordingly, the fixed blade is caused to swing according to circumstances during cutting from beginning to end, and the press-contact forces at the right and left two contact points can be equalized. Therefore, it is possible to reliably and entirely cut the recording sheet from the both right and left sides thereof without leaving an uncut portion, etc.

(3) In the cutter mechanism according the present invention, the first regulating member moves the fixed blade in a direction of moving away from the movable blade when the movable blade rides on the fixed blade, and is capable of releasing a contacting pressure of the fixed blade and the movable blade.

In the cutter mechanism according to the present invention, even if the recording sheet is jammed between the fixed blade and the movable blade at the time of cutting the recording sheet so that bite of both blades occurs, it is possible to easily recover the blades. That is, when the bite occurs, by the first regulating member, the cutting edge of the fixed blade is caused to swing with force against the biasing member so as to move in the direction away from the movable blade. Thus, it is possible to release the contacting pressure of the movable blade and the fixed blade, which is the cause of bite. Therefore, by removing the recording sheet, for example, it is possible to immediately recover the blades.

(4) The cutter mechanism according to the present invention, further includes: a first unit incorporating the fixed blade, the fixed blade holder, and the biasing member; and a second unit incorporating the movable blade, the second unit being combined with the first unit, in which one of the first unit and the second unit is separable from another one of the first unit and the second unit, and combination of the second unit with the first unit is releasable.

In the cutter mechanism according to the present invention, by combining the first unit and the second unit together, the fixed blade and the movable blade can easily and reliably face each other through the recording sheet. By separating the first unit and the second unit from each other, setting of the recording sheet can be easily performed. In particular, a cutter mechanism of a separation type in which the fixed blade and the movable blade separate can be made. Thus, the cutter mechanism can be employed in a versatile apparatus, and convenience can be enhanced.

In particular, the cutter mechanism can be preferably used in a thermal printer in which a paper roll is frequently replaced.

(5) A printer with a cutter, includes: the cutter mechanism according to the present invention; and a printing portion for performing printing on a recording sheet.

In the printer with a cutter according to the present invention, after the printing portion prints various characters, figures, and the like on the recording sheet, the recording sheet after printing is cut by the cutter mechanism. In this way, the cut recording sheet can be used for a receipt, a ticket, and the like.

In particular, by the cutter mechanism, the recording sheet can be reliably cut from the both right and left sides thereof without leaving an uncut portion, etc. Thus, a printer with a high degree of usability and improved reliability in terms of cutting performance can be obtained. Further, quality of the recording sheet after cutting can be enhanced.

According to the cutter mechanism of the present invention, it is possible to achieve a high swinging property of the fixed blade, to reliably cut the recording sheet from the both right and left sides thereof without leaving an uncut portion, etc., and to achieve simplification of a shape of the fixed blade and cost reduction.

Further, according to the printer with a cutter of the present invention, by the cutter mechanism, the recording sheet can be reliably cut from the both right and left sides thereof without leaving an uncut portion, etc. Thus, a printer with a high degree of usability and improved reliability in terms of cutting performance can be obtained.

DETAILED DESCRIPTION OF THE INVENTION

Hereinafter, embodiments according to the present invention are described with reference to FIGS. 1 to 26.

Note that, in this embodiment, a thermal printer is exemplified as one example of a printer with a cutter.

Figure 1:
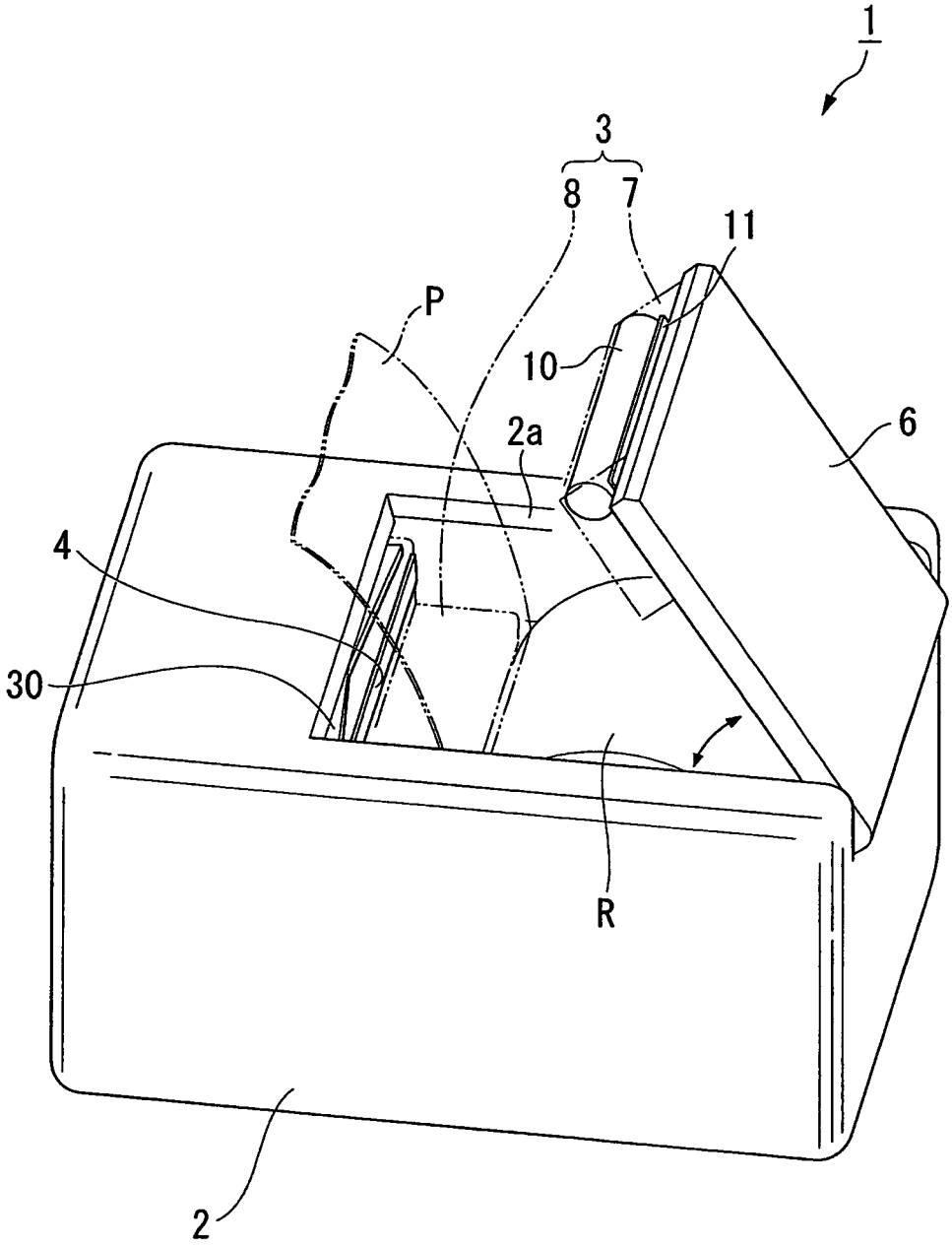
FIG. 1 is a perspective view of an outer appearance of a printer with a cutter according to an embodiment of the present invention, illustrating a state in which an open/close door is opened.
Figure 2:
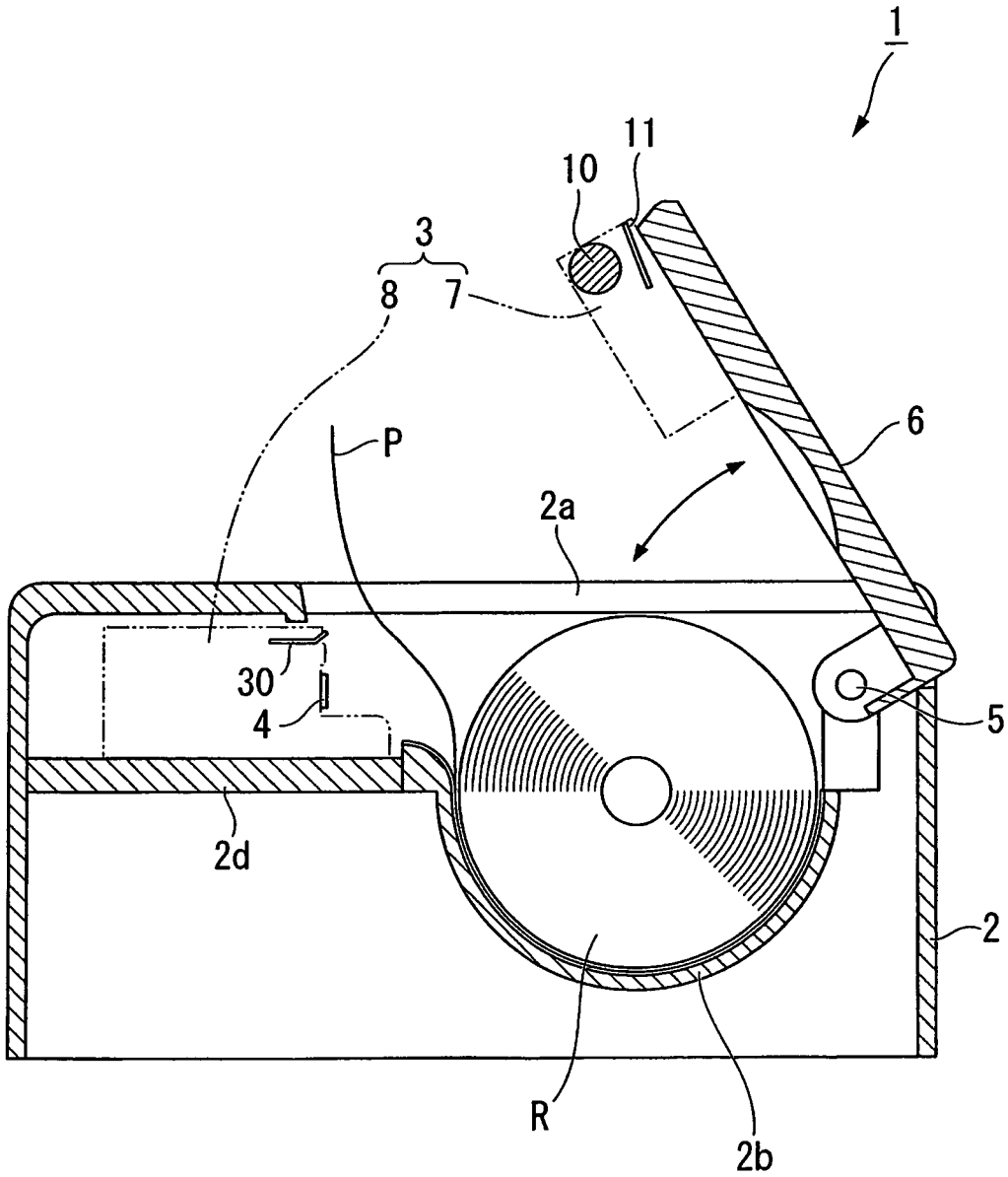
FIG. 2 is a cross-sectional view of the printer with a cutter illustrated in FIG. 1.

A thermal printer 1 of this embodiment is a printer that can appropriately cut a recording sheet P after printing on the recording sheet P pulled out from a paper roll R to use as a ticket, a receipt, and the like, and mainly includes a casing 2, a cutter mechanism 3, and a thermal head (printing unit) 4, as illustrated in FIG. 1 and FIG. 2.

The casing 2 is a casing molded from a plastic or a metal material, and is formed into a box-shape with an insertion port 2*a* opened at the upper surface. A mounting board 2*b* for mounting the paper roll R inserted from the insertion port 2*a* is arranged in the interior of the casing 2. The mounting board 2*b* is formed to curve into an arcuate shape, and enables the cylindrical paper roll R to be stably mounted.

An open/close door 6 fixed in an openable/closable manner through an intermediation of a hinge portion 5 is attached to the upper surface of the casing 2. The open/close door 6 opens and closes within a range of a constant angle from an opened state illustrated in FIG. 2 to a closed state illustrated in FIG. 3. The insertion port 2*a* appears when the open/close door 6 is opened, and hence the paper roll R can be inserted into or be taken out from the casing 2. A slight gap is designed to be formed between the distal end of the open/close door 6 and the casing 2 when the open/close door 6 is closed. The recording sheet P is pulled out from the interior of the casing 2 utilizing such gap. In other words, the gap functions as a discharge port 2*c* for the recording sheet P.

Note that the open/close door 6 automatically locks with respect to the casing 2 by a lock mechanism (not shown) when closed. The lock mechanism unlocks with one-touch from the outer side of the casing 2, and hence the open/close door 6 can be promptly opened.

The cutter mechanism 3 mainly incorporates a platen unit (first unit) 7 and a main unit (second unit) 8.

Figure 3:
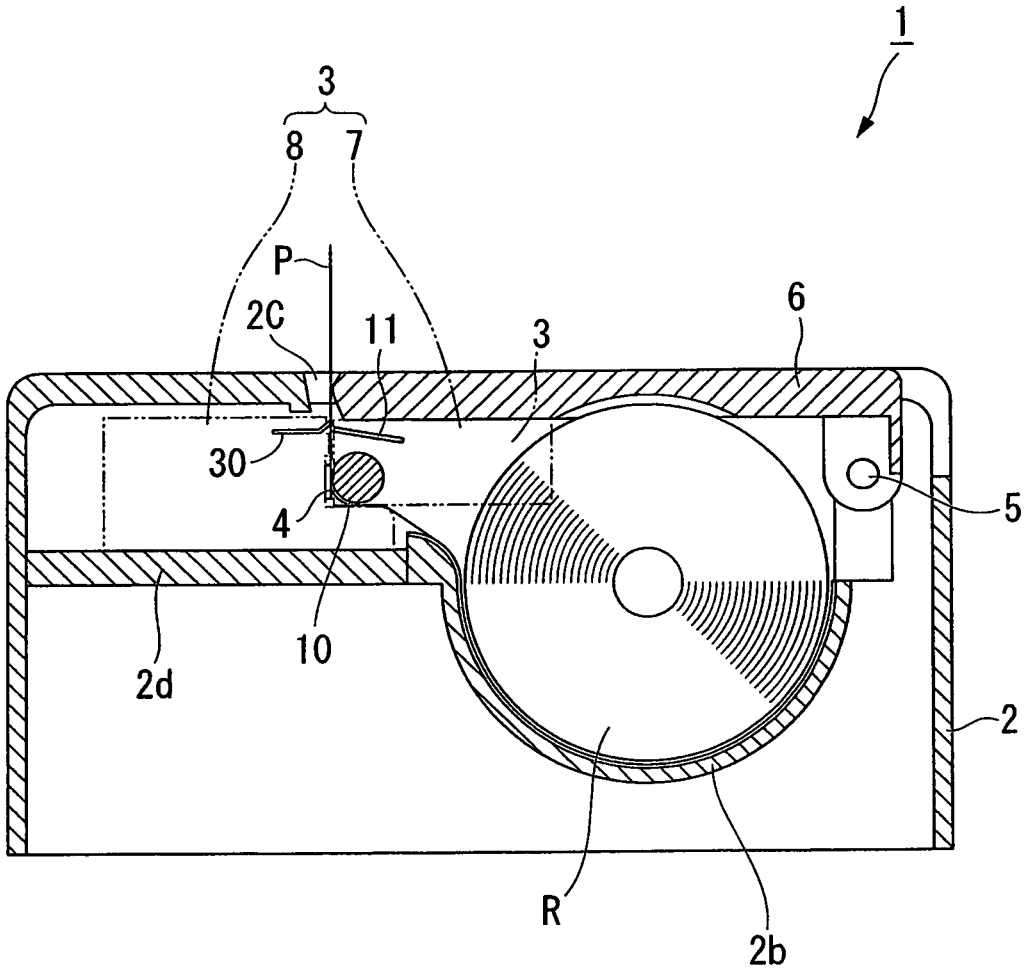
FIG. 3 is a view illustrating a state when the open/close door is closed from the state illustrated in FIG. 2.

The main unit 8 is a unit mainly incorporating a movable blade 30, a movable blade drive system 31, a lever portion 32, and a thermal head 4, as hereinafter described, and is arranged in the casing 2, as illustrated in FIG. 1 to FIG. 3. Specifically, it is fixed on an inner plate 2*d* integrally formed with the mounting board 2*b* on which the paper roll R is mounted. Note that, in FIG. 1 to FIG. 3, the movable blade 30 and the thermal head 4 are representatively illustrated.

The platen unit 7 is a unit mainly incorporating a fixed blade 11, a fixed blade holder 12, a coil spring (biasing member) 13, a cooperative mechanism 14, and a platen roller 10, which are described later, and is arranged on the inner surface of the distal end side of the open/close door 6 through an intermediation of an attachment plate 15. Thus, the platen unit 7 can move, combine with the main unit 8, or separate from the main unit 8 with the open/close operation of the open/close door 6. Note that, in FIG. 1 to FIG. 3, the fixed blade 11 and the platen roller 10 are representatively illustrated.

Here, the configuration of the platen unit 7 is first described in detail.

Figure 4:
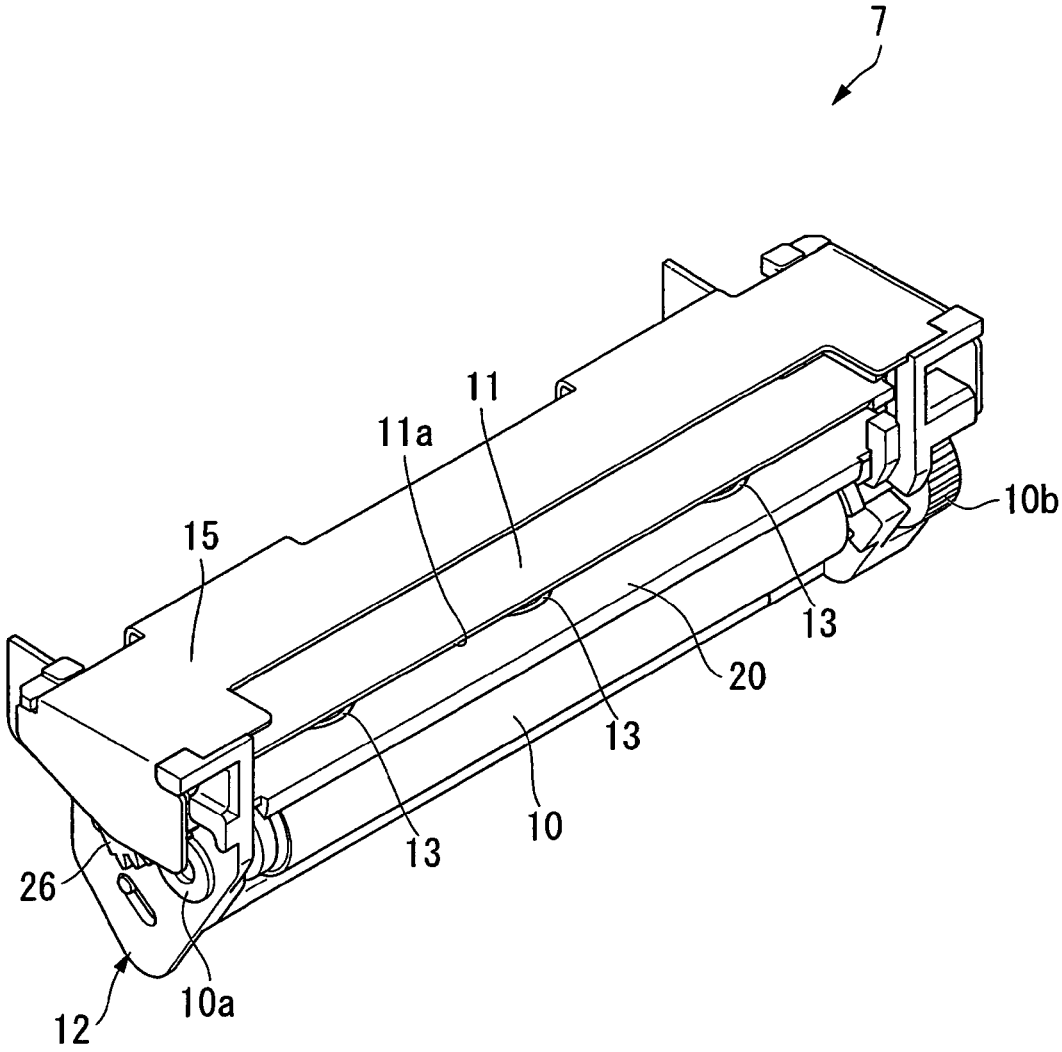
FIG. 4 is a perspective view of a platen unit serving as a component of a cutter mechanism configuring the printer with a cutter.
Figure 5:
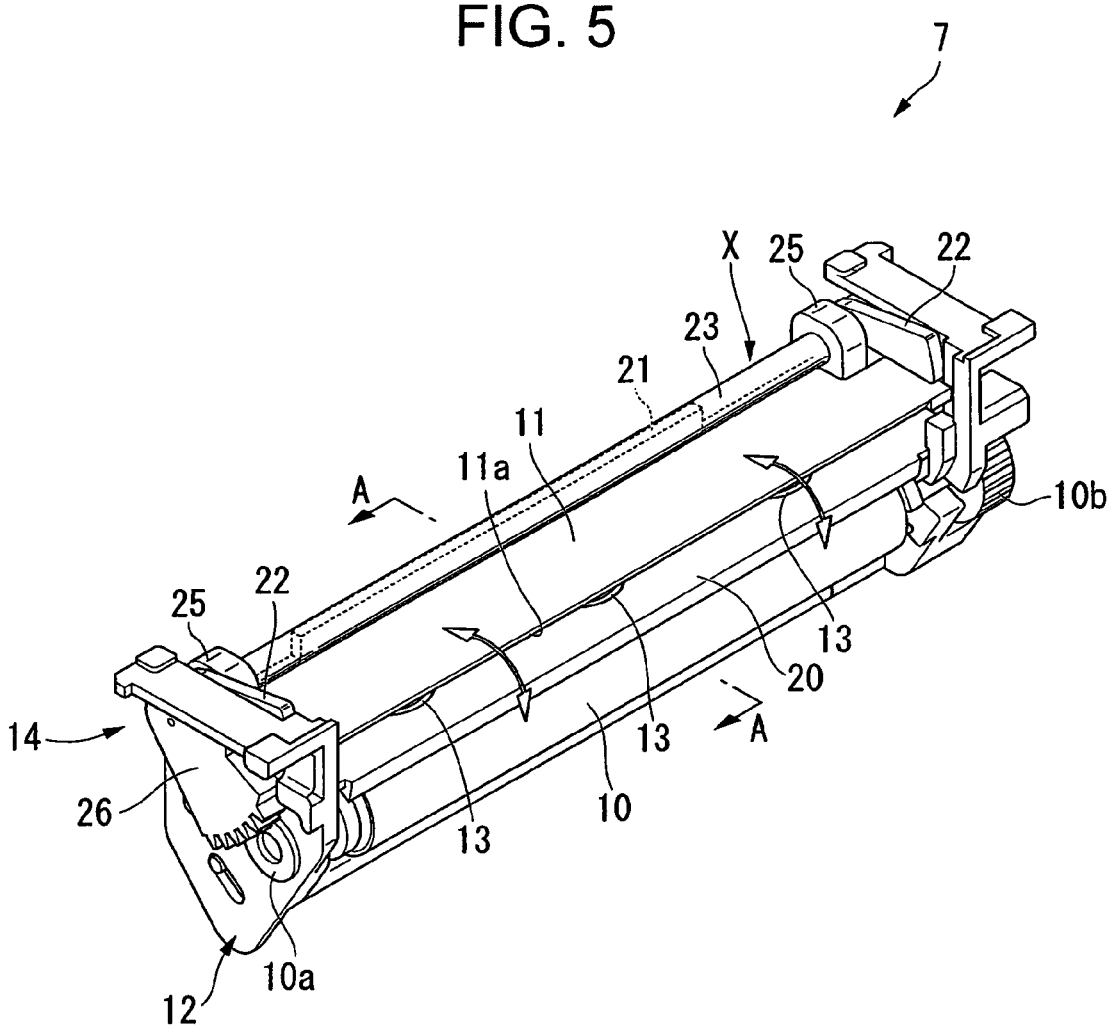
FIG. 5 is a view illustrating a state in which an attachment plate is detached from the state illustrated in FIG. 4.

As illustrated in FIG. 4 and FIG. 5, the platen unit 7 includes: the platen roller 10 made of an elastic body such as rubber, for feeding the recording sheet P; the fixed blade 11 arranged on the downstream side in the conveying direction of the recording sheet P with respect to the platen roller 10; the fixed blade holder 12 for rotatably supporting the platen roller 10 and holding the fixed blade 11; coil springs 13 for biasing the fixed blade 11; the cooperative mechanism 14 for moving the fixed blade 11 in a direction of moving away from the movable blade 30 and releasing the contacting pressure of the fixed blade 11 and the movable blade; and a metal attachment plate 15 covering the upper side of the fixed blade holder 12. Note that, FIG. 5 is a view illustrating a state in which the attachment plate 15 is detached from FIG. 4.

The platen roller 10 has a shaft body (not shown) extending from both ends, which are respectively covered with a cylindrical bearing 10*a*. The platen roller 10 then can rotate even if the two bearings 10*a* are held down. The platen roller 10 is supported by the fixed blade holder 12 through an intermediation of the bearing 10*a*. In this case, a driven gear 10*b* is fixed to one end side of the platen roller 10 with the bearing 10*a* sandwiching therebetween while being coupled to the shaft body.

In particular, as illustrated in FIG. 3, the platen roller 10 is arranged such that the outer peripheral surface is brought into contact with the thermal head 4 on the main unit 8 side with the recording sheet P sandwiching therebetween when the open/close door 6 is closed and the platen unit 7 and the main unit 8 are combined.

In this case, the driven gear 10*b* gears with a platen gear train 600 described later, on the main unit 8 side so that the rotational force is transmitted. The platen roller 10 then rotates by the rotational force transmitted from the main unit 8 side after the open/close door 6 is closed, and feeds the recording sheet P pulled out from the paper roll R to the outside of the casing 2 from the discharge port 2*c*.

Figure 6:
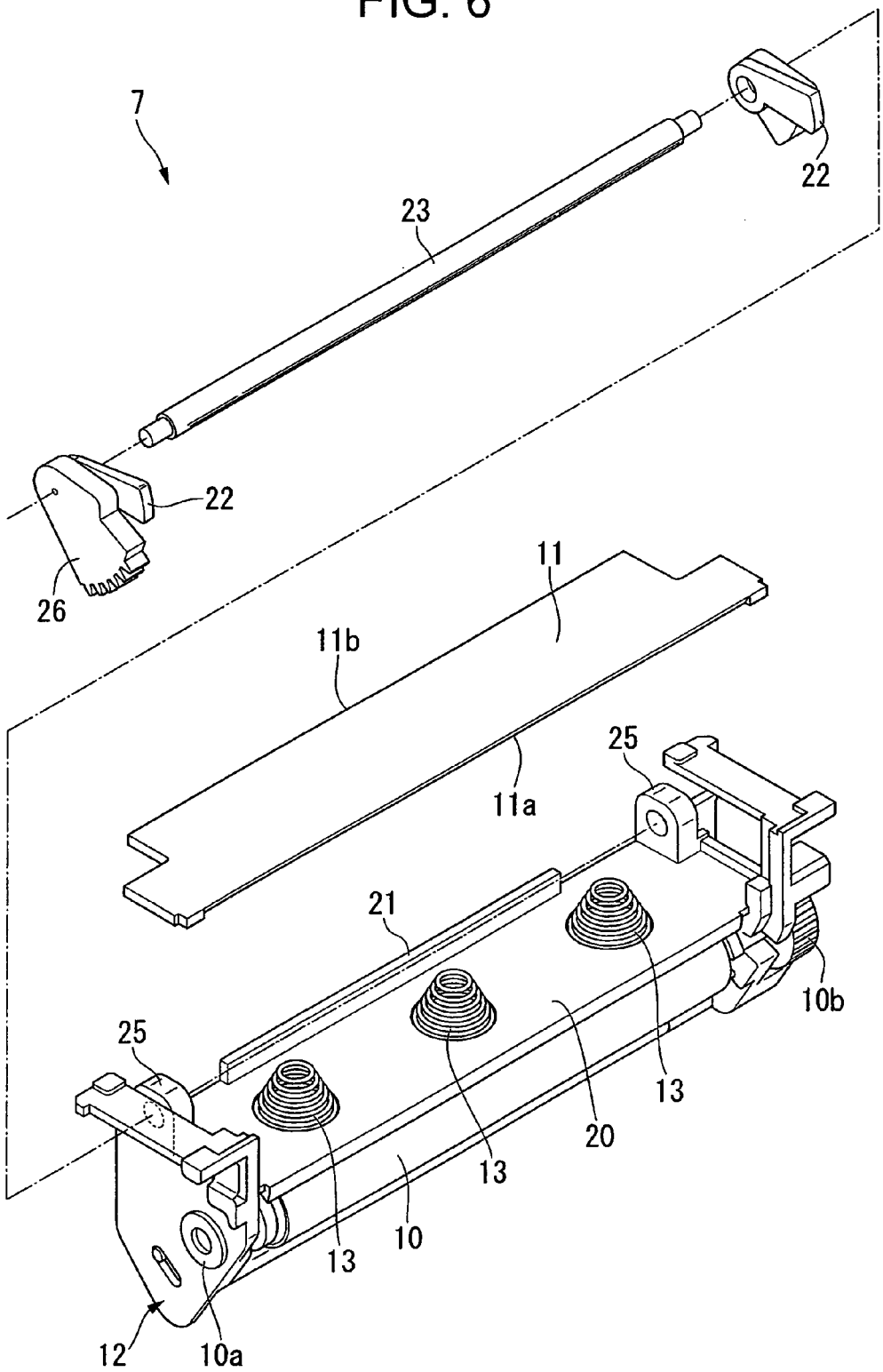
FIG. 6 is a view illustrating a state in which the platen unit illustrated in FIG. 5 is partially disassembled.
Figure 7:
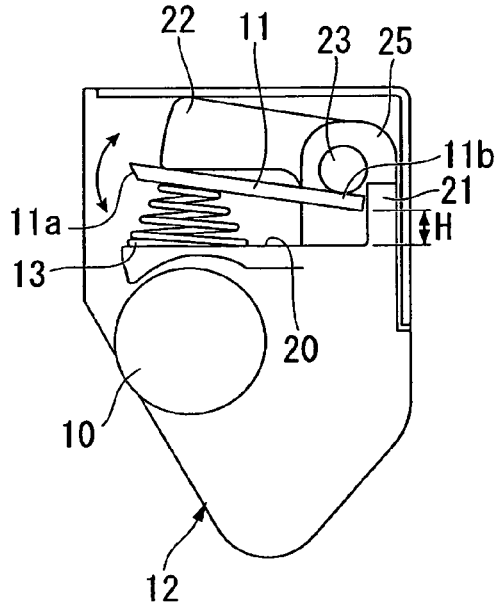
FIG. 7 is a cross-sectional view taken along the arrow A-A of FIG. 5.

As illustrated in FIG. 5 to FIG. 7, the fixed blade 11 is a plate-shaped blade extending in the width direction of the recording sheet P. Of two parallel sides of the fixed blade, one side serves as a cutting edge 11*a*, and the other side serves as a root portion 11*b*. Note that, a blade width direction of the fixed blade 11 corresponds to a longitudinal direction thereof extending along the width direction of the recording sheet P.

The thus formed fixed blade 11 is held by the fixed blade holder 12 so that the cutting edge 11*a* faces the fed recording sheet P when the open/close door 6 is closed.

In this case, the fixed blade 11 is held at a position away from a base portion 20 described later so that the cutting edge 11*a* swings in the up-down direction (direction substantially orthogonal to the sliding direction of the movable blade 30) about the root portion 11*b*.

Here, the fixed blade holder 12 is described in detail.

The fixed blade holder 12 includes: the flat base portion 20 located above the platen roller 10; a wall portion 21 provided to protrude on the base portion 20, for positioning the fixed blade 11 in the sliding direction of the movable blade 30 by coming into contact with the root portion 11*b*; stoppers (first regulating member) 22 for regulating lifting of the cutting edge 11*a* of the fixed blade 11 biased by the coil springs 13; and a shaft (second regulating member) 23 for regulating lifting of the root portion 11*b* of the fixed blade 11 biased in a state in which a predetermined gap H (see FIG. 7) is formed between the base portion 20 and the root portion 11*b*.

The above-mentioned coil springs 13 are fixed on the base portion 20. In this embodiment, three coil springs are fixed at intervals along the blade width direction of the fixed blade 11. The fixed blade 11 is biased by the coil springs 13 in a direction of moving away from the base portion 20. With this configuration, the cutting edge 11*a* of the fixed blade 11 is constantly biased so as to be lifted up.

Note that, in this embodiment, the example of adopting the coil springs 13 is described. However, any configuration may be adopted as long as the fixed blade 11 can be biased, and a plate spring and the like may be adopted. Further, the number of the coil springs 13 is not limited to three. There may be also adopted a configuration in which a positioning plate for positioning the coil springs 13 is mounted on the base portion 20 and the coil springs 13 are fixed through the positioning plate.

The fixed blade 11 biased by the coil springs 13 moves away from the base portion 20 as described above, and can swing in the up-down direction so that the cutting edge 11*a* moves along an arc trace in a state in which the root portion 11*b* is held in contact with the wall portion 21. In this case, as described above, the stoppers 22 regulate the lifting of the cutting edge 11*a*, and the shaft 23 regulates the lifting of the root portion 11*b*.

The shaft 23 is arranged above the root portion 11*b* of the fixed blade 11 along the fixed blade 11, and is rotatably supported by two bearing members 25 provided to protrude on the base portion 20. Therefore, without moving in the up-down direction, the shaft 23 can reliably regulate the lifting of the root portion 11*b* of the fixed blade 11.

Further, the above-mentioned stoppers 22 are respectively coupled to both end portions of the shaft 23 located on the outer sides of the bearing members 25, and are located above both end sides of the fixed blade 11. The stoppers 22 can rotate together with the shaft 23. However, the stoppers 22 cannot move upward because the stoppers 22 are partially engaged with the fixed blade holder 12. Therefore, it is possible to regulate the lifting of the cutting edge 11*a* of the fixed blade 11.

Incidentally, of the two stoppers 22, one stopper 22 is integrally provided with a sector gear 26. When the open/close door 6 is closed, the sector gear 26 gears with an internal gear 32*a* of the lever portion 32 to be described later, the lever portion 32 being provided on the main unit 8 side and allowed to be push-down manipulated. Thus, the sector gear 26 rotates in conjunction with the manipulation of the lever portion 32, that is, in conjunction with the push-down operation. Note that, when the sector gear 26 rotates, the shaft 23 rotates so as to push down the two stoppers 22. Note that, the phrase "in conjunction with the manipulation of the lever portion 32" is appropriately described below as a meaning of "in conjunction with the push-down operation of the lever portion 32".

Therefore, the stoppers 22 in this embodiment not only regulate the lifting of the cutting edge 11*a* of the fixed blade 11, but also rotate together with the shaft 23 in accordance with rotation of the sector gear 26 and act to push down the cutting edge 11*a* of the fixed blade 11 downward. The fixed blade 11 then moves to move away from the movable blade 30, and the contacting pressure of the blades 11 and 30 is canceled.

In other words, the stoppers 22, the sector gear 26, and the shaft 23 function as the cooperative mechanism 14 for moving the fixed blade 11 in the direction of moving away from the movable blade in conjunction with the manipulation of the lever portion 32, and canceling the contacting pressure of the blades 11 and 30.

Figure 8:
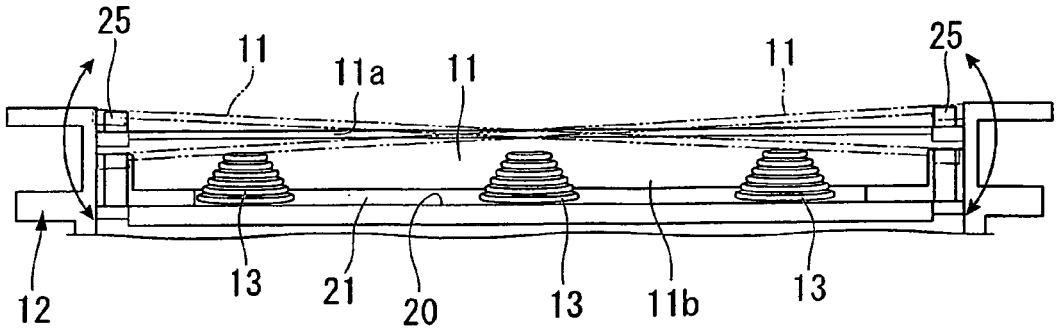
FIG. 8 is a view of the platen unit illustrated in FIG. 5 seen from a side of a cutting edge of a fixed blade.

Incidentally, the above-mentioned fixed blade 11 is moved away from the base portion 20 by the coil springs 13, and the predetermined gap H is formed between the root portion 11*b* and the base portion 20. Thus, as illustrated in FIG. 8, the fixed blade 11 can swing freely in the blade width direction with a high degree of freedom.

Next, the main unit 8 is described in detail below.

Figure 9:
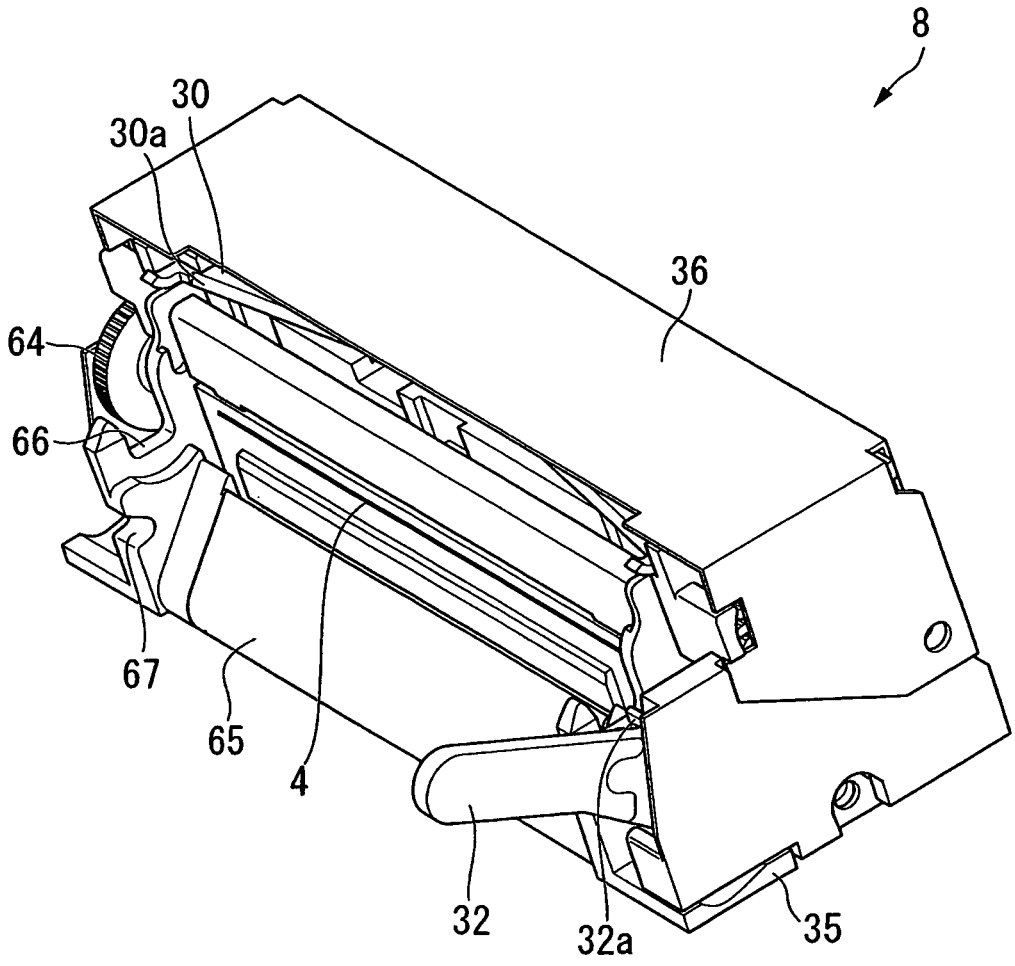
FIG. 9 is a perspective view of a main unit serving as a component of a cutter mechanism configuring the printer with a cutter.
Figure 10:
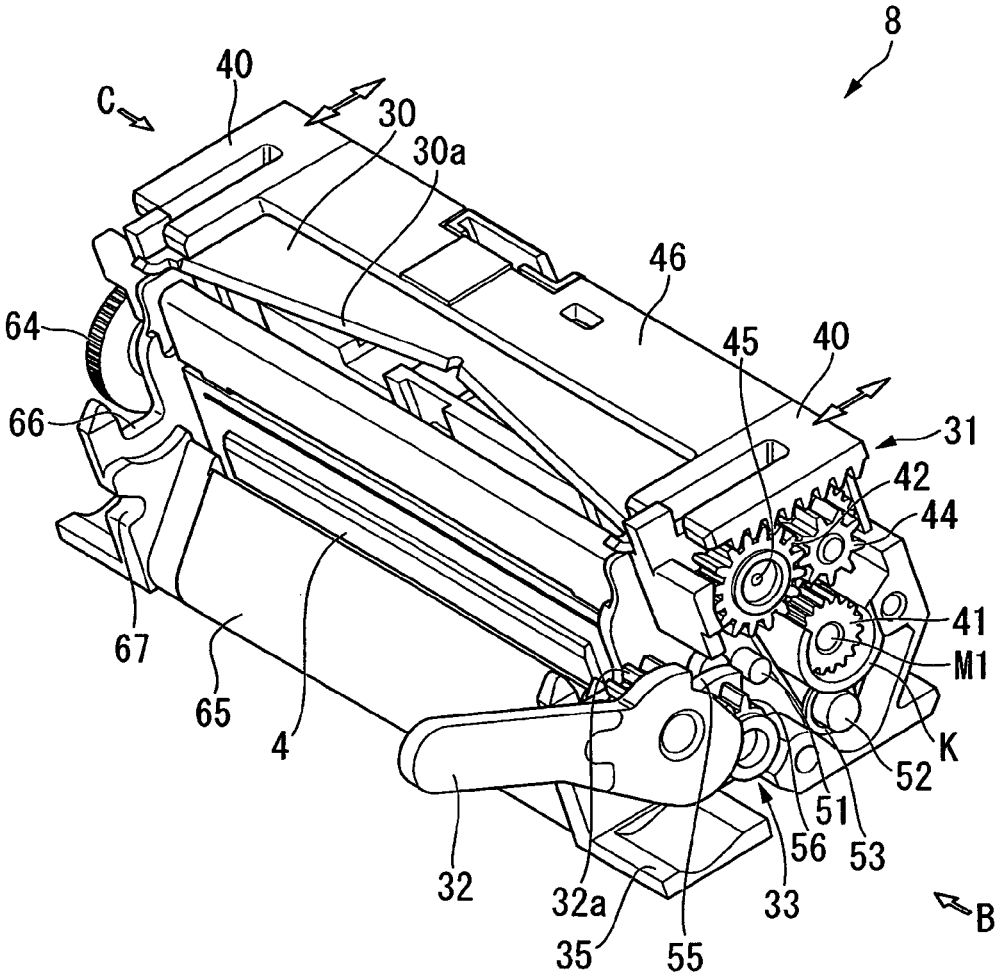
FIG. 10 is a view illustrating a state in which a cover plate is detached from the state illustrated in FIG. 9.

As illustrated in FIG. 9 and FIG. 10, the main unit 8 includes the movable blade 30 slidably movable with respect to the fixed blade 11, the movable blade drive system 31 for driving the movable blade 30, the lever portion 32 that can be push-down manipulated, a cancel mechanism 33 for separating the mechanical connection of a drive gear 41 and a rack 40, which are described later, in conjunction with the push-down operation of the lever portion 32, the thermal head 4 for performing recordation on the pulled out recording sheet P, a metal support frame 35 fixed on the internal plate 2*d*, for supporting each component, and a metal cover plate 36 for covering the upper side of the movable blade 30. FIG. 10 is a view illustrating a state in which the cover plate 36 is detached from FIG. 9.

Figure 11:
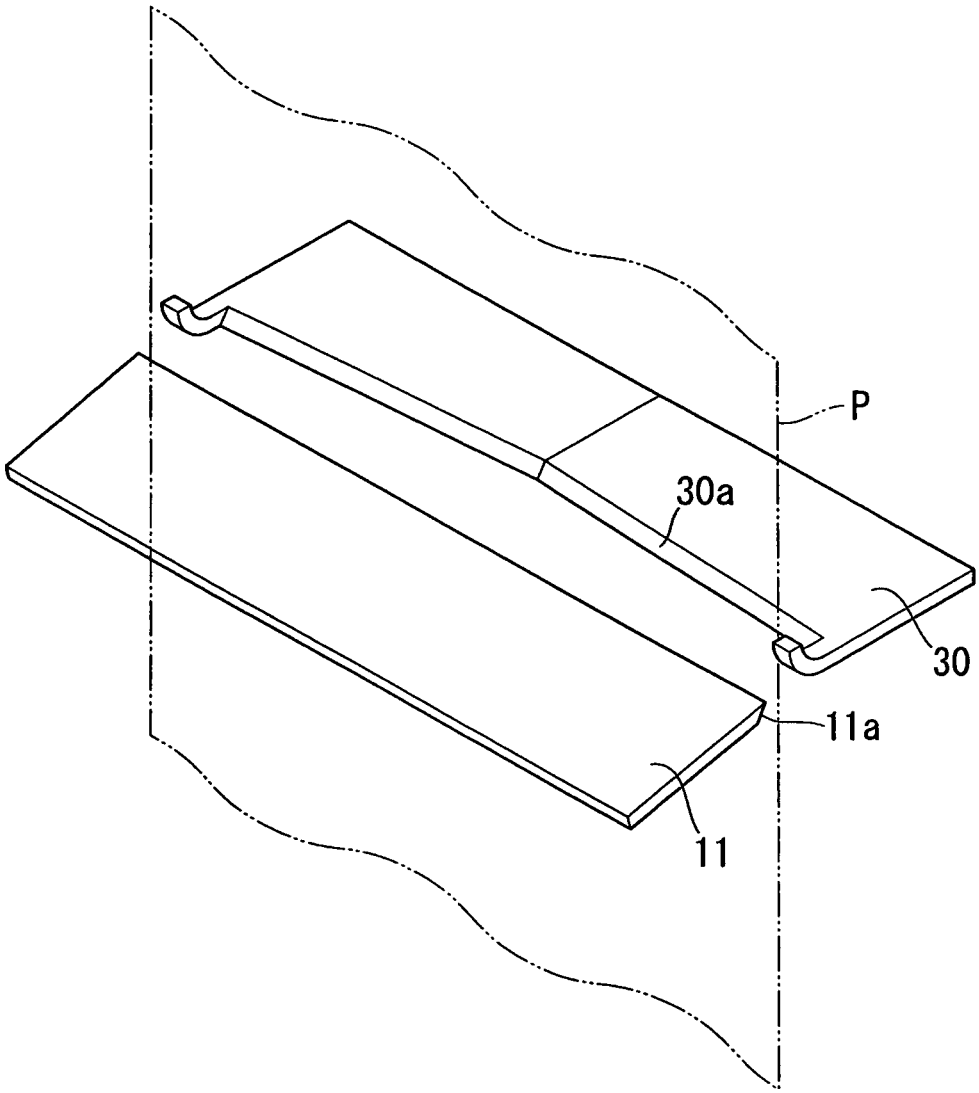
FIG. 11 is a view illustrating a positional relationship between the fixed blade and a movable blade during printing.
Figure 12:
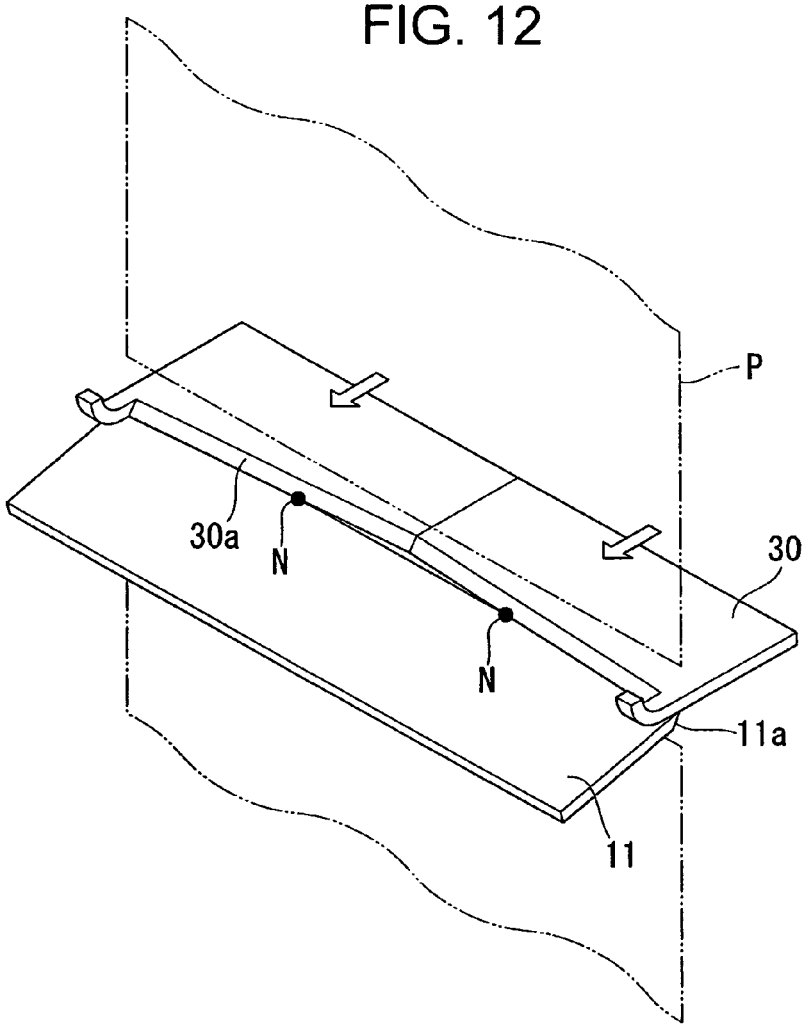
FIG. 12 is a view illustrating a state of sliding the movable blade from the state illustrated in FIG. 11, and cutting a recording sheet between the fixed blade and the movable blade.
Figure 13:
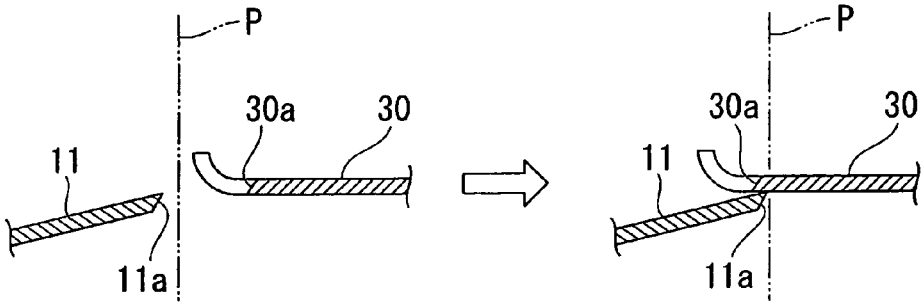
FIG. 13 is a cross-sectional view illustrating movement of the fixed blade and the movable blade while shifting from the state illustrated in FIG. 11 to the state illustrated in FIG. 12.

The movable blade 30 functions as a cutter in cooperation with the fixed blade 11, and is arranged at a position facing the fixed blade 11 while sandwiching the recording sheet P therebetween when the open/close door 6 is closed and the main unit 8 and the platen unit 7 are combined. As illustrated in FIG. 11, the movable blade 30 is a plate-shaped blade having a substantially V-shape in top view formed such that the length from the root to the cutting edge 30*a* gradually becomes shorter from both ends towards the middle. As illustrated in FIG. 12 and FIG. 13, when slid towards the fixed blade 11, the movable blade 30 rides on the upper surface of the fixed blade 11 to thereby sandwich and cut the recording sheet P with the fixed blade 11.

In this case, the movable blade 30 is formed into a substantially V-shape in top view, and hence the movable blade 30 comes into contact with the fixed blade 11 at right and left two points (points N illustrated in FIG. 12). Therefore, while slidably moving, the movable blade 30 cuts the recording sheet P from both right and left sides toward the middle thereof.

Note that, when the movable blade 30 is slid, the fixed blade 11 is pushed down by the movable blade 30 toward the platen roller 10. However, the fixed blade 11 is biased upward by the coil springs 13, and hence, as illustrated in FIG. 13, the fixed blade 11 is held in contact with the movable blade 30 at an appropriate contacting pressure.

Returning back to FIG. 9 and FIG. 10, the movable blade drive system 31 includes the rack 40 attached to the movable blade 30, and a first gear (rack gear) 42 and a third gear (rack gear) 43 (not shown in FIG. 9 and FIG. 10) which gear with the rack 40, rotate with the rotation of the drive gear 41 coupled to the forward/reverse rotatable motor for a cutter, and linearly move the rack 40. In this embodiment, the motor for a cutter and the drive gear 41 are provided in the main unit 8.

Figure 14:
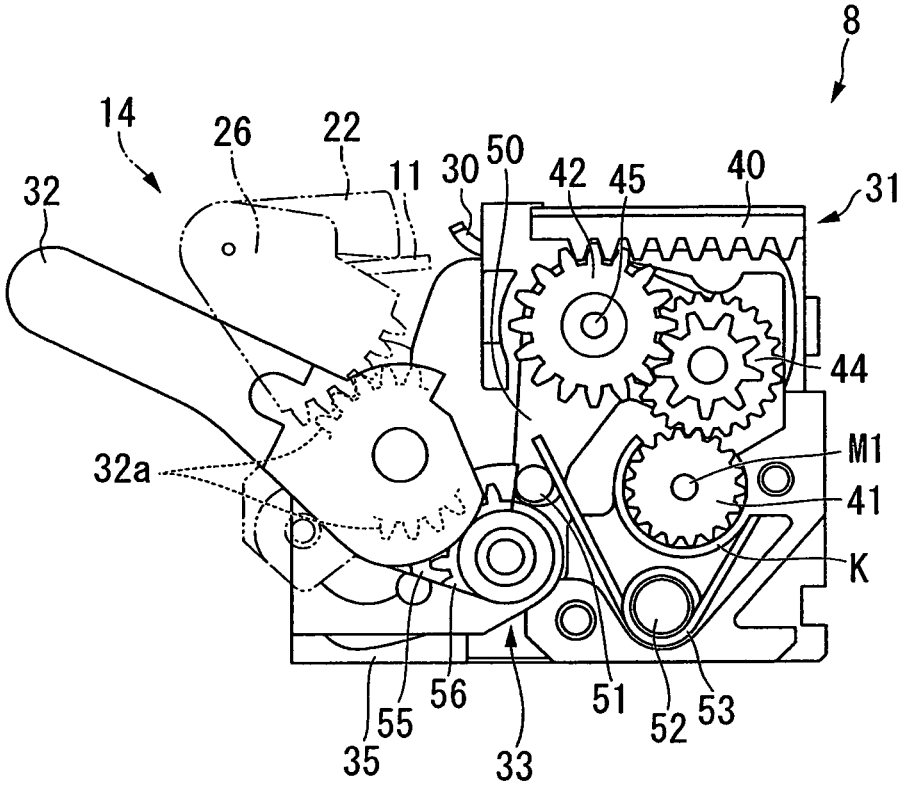
FIG. 14 is a side view of the main unit illustrated in FIG. 13 seen from a direction of an arrow B.

As illustrated in FIG. 10 and FIG. 14, the drive gear 41 is coupled to a drive shaft M1 of the motor for the cutter and is arranged on one side surface of the main unit 8. In this case, the drive gear 41 has a part of the peripheral surface protected by an arcuate protective cover K. The first gear 42 is arranged on the upper side of the drive gear 41 while being geared with the rack 40. A second gear 44, which gears with the gears 41, 42, is arranged between the first gear 42 and the drive gear 41.

Thus, when the drive gear 41 rotates by the drive of the motor for the cutter, the rotational force is transmitted to the first gear 42 via the second gear 44 so that the rack 40 linearly moves. That is, the first gear 42 rotates with the rotation of the drive gear 41, and linearly moves the rack 40.

Figure 15A:
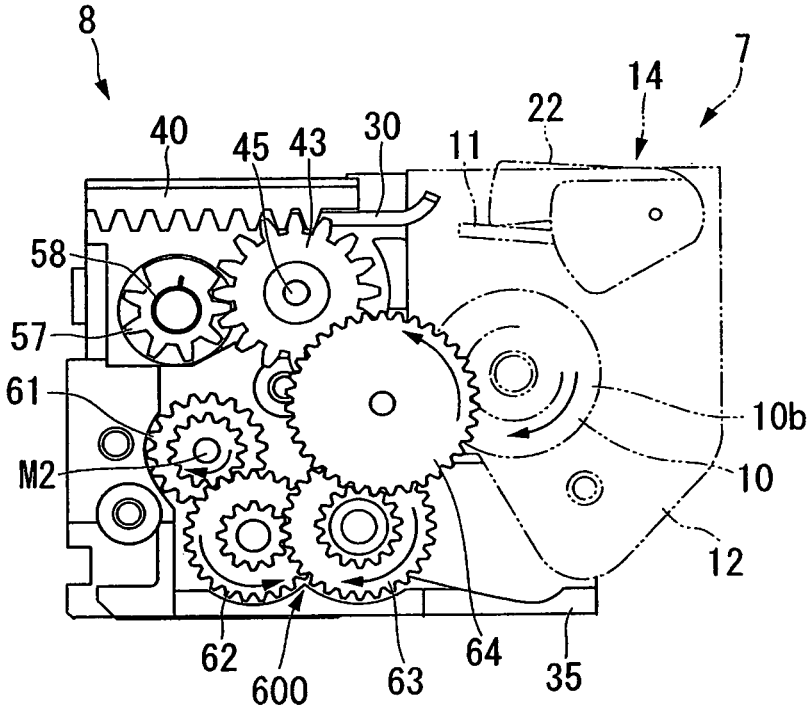
FIG. 15A is a side view of the main unit illustrated in FIG. 13 seen from a direction of an arrow C.

The first gear 42 is coupled to a shaft 45 extending to the other side surface of the main unit 8. As illustrated in FIG. 15A, the third gear 43 geared with the rack 40 is coupled to the shaft 45 at the other side surface of the main unit 8. Thus, the third gear 43 also rotates with the rotation of the first gear 42 to also linearly move the rack 40.

The rack 40 geared with the first gear 42 and the third gear 43 is attached to both ends of a flat support plate 46 fixed to the root portion side of the movable blade 30, as illustrated in FIG. 10. Thus, when the first gear 42 and the third gear 43 rotate, the two racks 40 simultaneously move in the same direction, and consequently slidably moves the movable blade 30.

Figure 16:
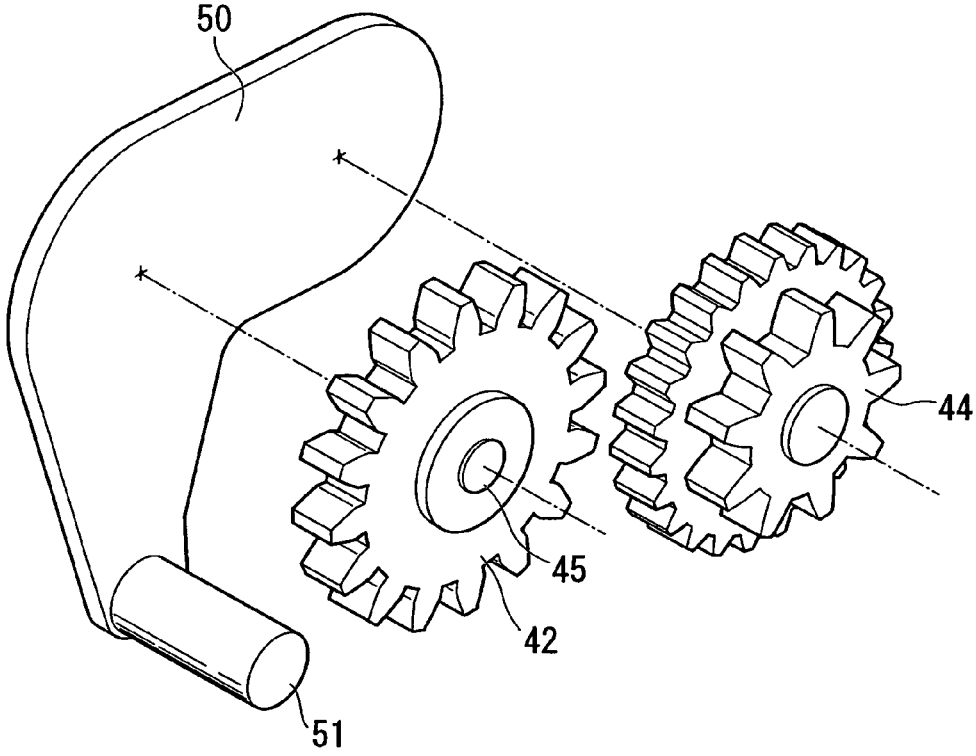
FIG. 16 is an enlarged perspective view illustrating an attachment state of a swinging plate, a first gear, and a second gear illustrated in FIG. 14.
Figure 17:
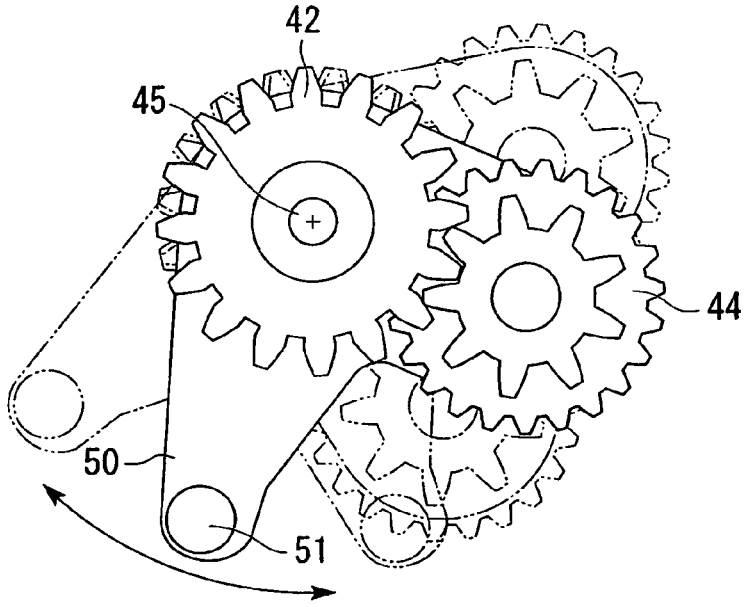
FIG. 17 is a front view of the swinging plate illustrated in FIG. 16.

As illustrated in FIG. 14, a swinging plate 50 formed into a substantially C-shape in plane view is arranged on the inner side of the first gear 42. As illustrated in FIG. 16 and FIG. 17, the swinging plate 50 swings to the left and the right about the shaft 45 coupled to the first gear 42. The second gear 44 is rotatably supported by the swinging plate 50. Thus, if the swinging plate 50 swings, the second gear 44 swings about the shaft 45.

A pin 51 projecting to the outer side of the main unit 8 is attached to the end of the swinging plate 50. As illustrated in FIG. 14, the second gear 44 moves in the direction of moving away from the drive gear 41 when the swinging plate 50 is moved to move the pin 51 closer to the drive gear 41, whereas the second gear 44 moves in the direction of moving closer to the drive gear 41 when the swinging plate 50 is moved to move the pin 51 away from the drive gear 41.

As illustrated in FIG. 10 and FIG. 14, a fixed pin 52 is formed on the lower side of the drive gear 41 in adjacent to the protective cover K. A torsion spring 53 is fixed to the fixed pin 52. One end side of the torsion spring 53 is fixed to the support frame 35, and the other end side is constantly biased in the direction of moving the pin 51 of the swinging plate 50 away from the drive gear 41. As described above, the second gear 44 and the drive gear 41 are constantly geared with each other in normal time.

The lever portion 32 is arranged adjacent to the swinging plate 50. The lever portion 32 is rotatably supported on the inner side of the cover plate 36, and hence it can be pushed downward. The lever portion 32 can be manipulated from the outer side of the casing 2 through an intermediation of a coupling mechanism (not shown).

An internal gear 32*a* is formed on the inner side of the lever portion 32, and hence a part of the internal gear 32*a* gears with the sector gear 26 on the platen unit 7 side when the open/close door 6 is closed and the main unit 8 and the platen unit 7 are combined. Thus, the cooperative mechanism 14 operates in conjunction with the push-down operation of the lever portion 32, as described above.

A release plate 55 formed into a fan-shape is arranged between the lever portion 32 and the swinging plate 50, and is rotatably supported by the support frame 35. A release gear 56 is attached to the release plate 55, and is geared with a part of the internal gear 32*a* of the lever portion 32. Thus, when the lever portion 32 is pushed down, the release plate 55 rotates towards the drive gear 41.

The pin 51 of the swinging plate 50 biased by the torsion spring 53 is held in contact with the side surface of the release plate 55. Thus, when the release plate 55 rotates towards the drive gear 41, the pin 51 is pushed towards the drive gear 41 against the biasing force of the torsion spring 53, thereby moving the swinging plate 50. As a result, the second gear 44 moves away from the drive gear 41, thereby releasing the geared state thereof. The second gear 44, the first gear 42, and the rack 40 then enter a free state.

That is, the mechanical connection between the rack 40 and the drive gear 41 is separated, and the movement regulation of the rack 40 is released to a free state. In other words, the swinging plate 50, the pin 51, the torsion spring 53, and the release plate 55 described above function as a release mechanism 33.

Figure 15B:
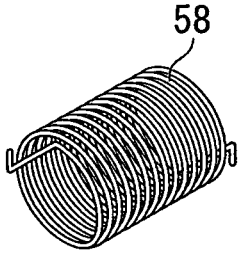
FIG. 15B is a perspective view of a coil spring incorporated in a pinion illustrated in FIG. 15A.

As illustrated in FIG. 15A, a pinion 57 gearing with the third gear 43 is rotatably supported by the support frame 35 at the other side surface of the main unit 8. As illustrated in FIG. 15B, a coil spring 58 is incorporated in the pinion 57. When the third gear 43 rotates and slidably moves the movable blade 30 toward the fixed blade 11, the coil spring 58 is twisted and compressed, and rotatably biases the pinion 57 so as to reversely rotate the third gear 43 by a restoring force from the torsion. However, the third gear 43 is engaged with the drive gear 41 through the shaft 45 in normal time, and hence the third gear 43 cannot reversely rotate with the force of the coil spring 58.

However, when the movement regulation of the rack 40 is released by the release mechanism 33 so as to enter a free state, the third gear 43 reversely rotates by the force of the coil spring 58. As a result, the movable blade 30 can be automatically returned to the original position.

That is, the coil spring 58 functions as a biasing member for biasing the movable blade 30 to return to a predetermined position, and automatically moving the movable blade 30 to a predetermined position when the movement regulation of the rack 40 is released.

Further, a platen gear train 600 geared with the driven gear 10*b* on the platen unit 7 side when the main unit 8 and the platen unit 7 are combined, and a platen drive gear 61 coupled to a drive shaft M2 of the platen motor (not shown) and geared with the platen gear train 600 are arranged on the lower side of the pinion 57.

The platen gear train 600 includes a fourth gear 62 gearing with the platen drive gear 61, a fifth gear 63 gearing with the fourth gear 62, and a sixth gear 64 gearing with the fifth gear 63 and the driven gear 10*b*.

As illustrated in FIG. 9 and FIG. 10, the thermal head 4 is formed to extend in the width direction of the recording sheet P, and is arranged at a position facing the platen roller 10 when the open/close door 6 is closed. The thermal head 4 includes a great number of heat generating elements (not shown), and is biased towards the platen roller 10 by a coil spring (not shown) and the like. Thus, the thermal head 4 can be reliably pressed against the recording sheet P fed by the platen roller 10, thereby enabling satisfactory printing.

The lower side of the thermal head 4 is provided with a guide board 65 formed to curve so that the recording sheet P can be smoothly pulled in. A fit-in hole 66 to be fitted with a bearing 10*a* arranged at the shaft part of the platen roller 10 is formed on the upper side of the guide board 65. That is, when the open/close door 6 is closed, the baring 10*a* of the platen roller 10 naturally fits into the fit-in hole 66. The main unit 8 and the platen unit 7 are thereby combined.

Note that, the plate unit 3 is attached with a lock shaft (not shown) that fits into a lock groove 67 formed on the lower side of the fit-in hole 66. The lock shaft is a shaft arranged parallel to the platen roller 10 in the vicinity of the platen roller 10, and is automatically locked within the lock groove 67 when the units 7 and 8 are combined. As a result, the units 7 and 8 cannot separate unless the lock is unlocked. The unlocking of the lock is carried out in conjunction with the lock mechanism for unlocking the lock of the open/close door 6.

Next, the operation of the thermal printer 1 configured as described above is described.

First, as illustrated in FIG. 1 and FIG. 2, the paper roll R is placed in the casing 2 from the insertion port 2*a* with the open/close door 6 being opened. In this case, the recording sheet P is pulled out by a length of a certain extent to the outer side of the casing 2 in advance. The open/close door 6 is closed and the open/close door 6 is locked by the lock mechanism with the pulled out recording sheet P being pulled out to the outer side of the casing 2. When the open/close door 6 is closed, the bearing 10*a* of the platen roller 10 is fitted into and fitted with the fit-in hole 66 on the main unit 8 side, and the lock shaft fits into and automatically locked with the lock groove 67 on the main unit 8 side. The main unit 8 and the platen unit 7 are thereby combined to each other.

As illustrated in FIG. 3, the recording sheet P is sandwiched between the platen roller 10 and the thermal head 4, and is pulled out to the outer side of the casing 2 from the discharge port 2*c*.

After setting the paper roll R as described above, various information are printed on the recording sheet P.

First, as illustrated in FIG. 15A, the platen motor is driven to rotate the platen drive gear 61. Then, the rotational force is transmitted to the driven gear 10*b* through the platen gear train 600, thereby rotating the platen roller 10. The recording sheet P sandwiched between the outer peripheral surface of the platen roller 10 and the thermal head 4 is thereby fed to the upper side of the casing 2, and the paper roll R mounted on the mounting board 2*b* rotates.

The thermal head 4 is operated at the same time. A great number of heat generating elements then appropriately emit heat. Various characters, figures, and the like then can be clearly printed on the fed recording sheet P. Thereafter, the recording sheet P further fed out by the platen roller 10 is further fed into the cutter mechanism 3 and passes between the fixed blade 11 and the movable blade 30.

Figure 18:
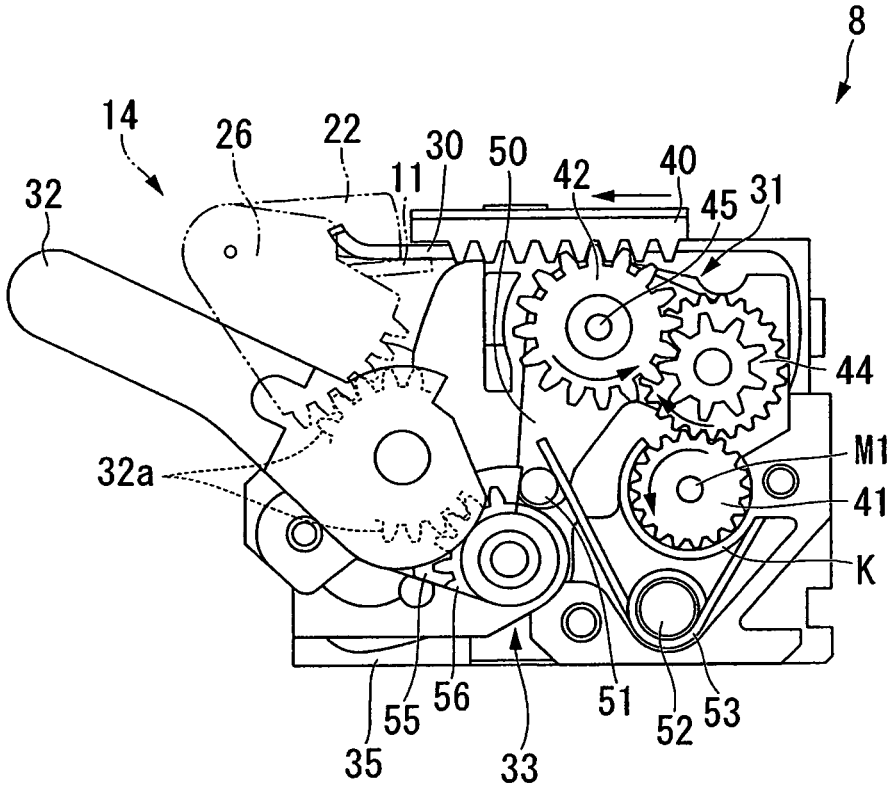
FIG. 18 is a view illustrating a state of slidably moving the movable blade from the state illustrated in FIG. 14.

Next, when the printing is terminated and the recording sheet P is to be cut, the motor for the cutter is driven to rotate the drive gear 41. As illustrated in FIG. 18, the rotational force is transmitted to the first gear 42 through the second gear 44, thereby rotating the first gear 42. At the same time, the third gear 43 coupled to the first gear 42 through an intermediation of the shaft 45 rotates. The rack 40 geared with the first gear 42 and the third gear 43 then linearly moves. The movable blade 30 slidably moves towards the fixed blade 11 so as to shift from the state illustrated in FIG. 19 and FIG. 21A to the state illustrated in FIG. 20 and FIG. 21B through the support plate 46 to which the rack 40 is fixed.

Figure 19:
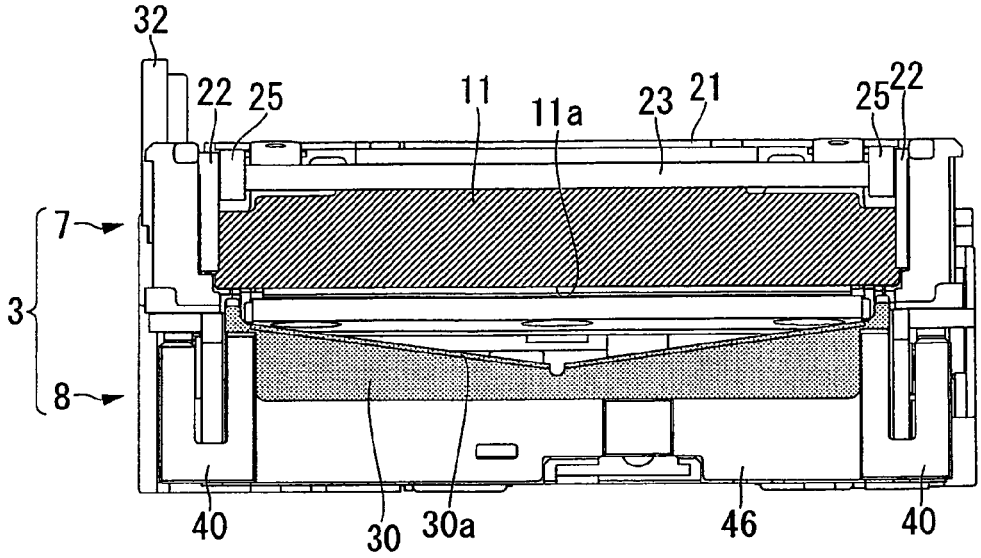
FIG. 19 is a top view of the cutter mechanism when the platen unit illustrated in FIG. 5 and the main unit illustrated in FIG. 10 are combined.
Figure 20:
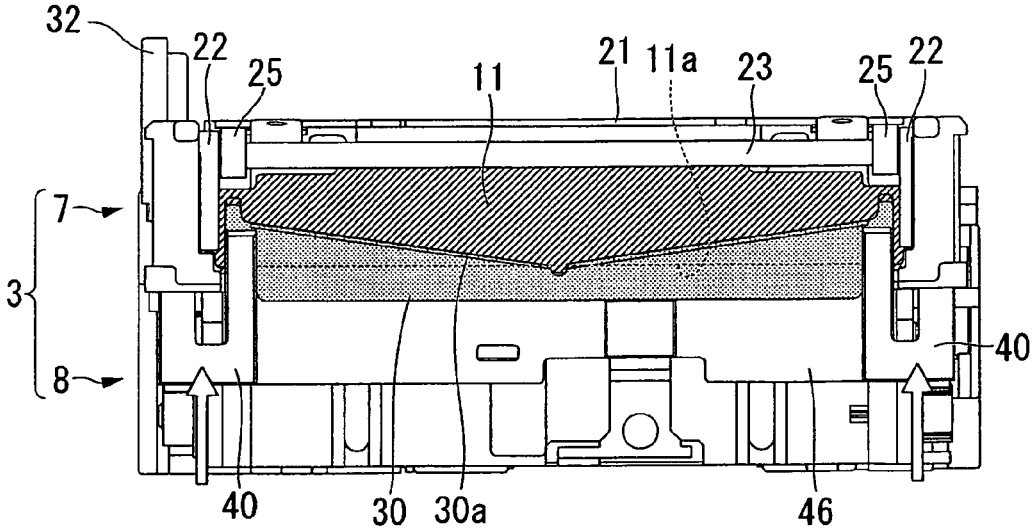
FIG. 20 is a view illustrating a state of slidably moving the movable blade from the state illustrated in FIG. 19.
Figure 21A:
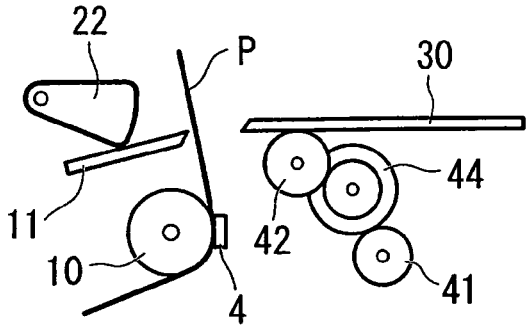
FIGS. 21A to 21D are schematic views illustrating each operation state of the printer with a cutter illustrated in FIG. 1, FIG. 21A illustrating a state of printing on the recording sheet, FIG. 21B illustrating a state of cutting the recording sheet, FIG. 21C illustrating a state of releasing the bite of the fixed blade and the movable blade, FIG. 21D illustrating a state in which the open/close door is opened.
Figure 21B:
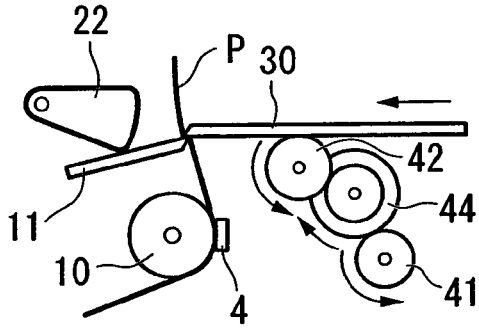

The state illustrated in FIG. 19 and FIG. 21A is the state before the movable blade 30 slidably moves, and the state in which the movable blade 30 is at a predetermined position. In FIG. 19 and FIG. 20, the fixed blade 11 and the movable blade 30 are illustrated in a hatched state to facilitate the visualization of the figures.

As illustrated in FIG. 12 and FIG. 13, the slidably moved movable blade 30 rides on the upper surface of the fixed blade 11, and hence the respective cutting edges 11*a* and 30*a* overlap. The recording sheet P then can be sandwiched and cut between the fixed blade 11 and the movable blade 30.

In this case, the movable blade 30 is formed into a substantially V-shape in top view, and hence the movable blade 30 comes into contact with the fixed blade 11 at the right and left two points. Therefore, in accordance with the slidable movement of the movable blade 30, it is possible to cut the recording sheet P from the both right and left sides toward the middle thereof, and to sharply cut the recording sheet P without skew. As a result, the recording sheet P after printing can be used for a receipt, a ticket, and the like.

Incidentally, when the movable blade 30 rides on the fixed blade 11, the fixed blade 11 is likely to be pushed back toward the base portion 20. However, the fixed blade 11 is biased upward by the coil springs 13. Therefore, the fixed blade 11 and the movable blade 30 can be held in contact with each other at the appropriate contacting pressure. In particular, the cutting edge 11*a* of the fixed blade 11 can be appropriately brought into press-contact with a cutting edge 30*a* of the movable blade 30. Accordingly, a gap is hardly formed between the cutting edge 11*a* of the fixed blade 11 and the cutting edge 30*a* of the movable blade 30, and it is possible to cut the recording sheet P with a sharp cutting edge.

In addition, unlike a conventional fixed blade restricted in a swinging property in the blade width direction, as illustrated in FIG. 8, the fixed blade 11 in this embodiment can swing in the blade width direction with a high degree of freedom while using the predetermined gap H secured between the base portion 20 and the root portion 11*b*. Thus, the fixed blade 11 swings freely in the blade width direction according to circumstances during cutting from beginning to end, and press-contact forces at right and left two contact points can be equalized. Therefore, it is possible to reliably and entirely cut the recording sheet P from the both right and left sides thereof without leaving an uncut portion, etc.

Further, even when the recording sheet P is jammed between the fixed blade 11 and the movable blade 30 during use so that bite of the both blades 11 and 30 occurs, it is possible to easily recover the blades.

Figure 21C:
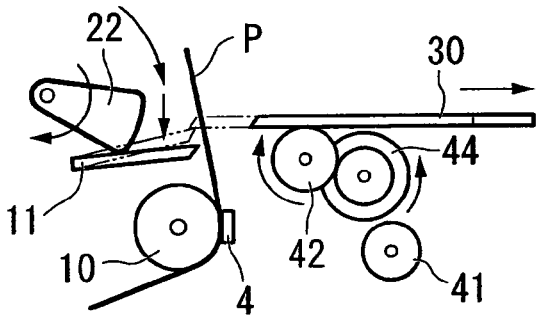
Figure 22:
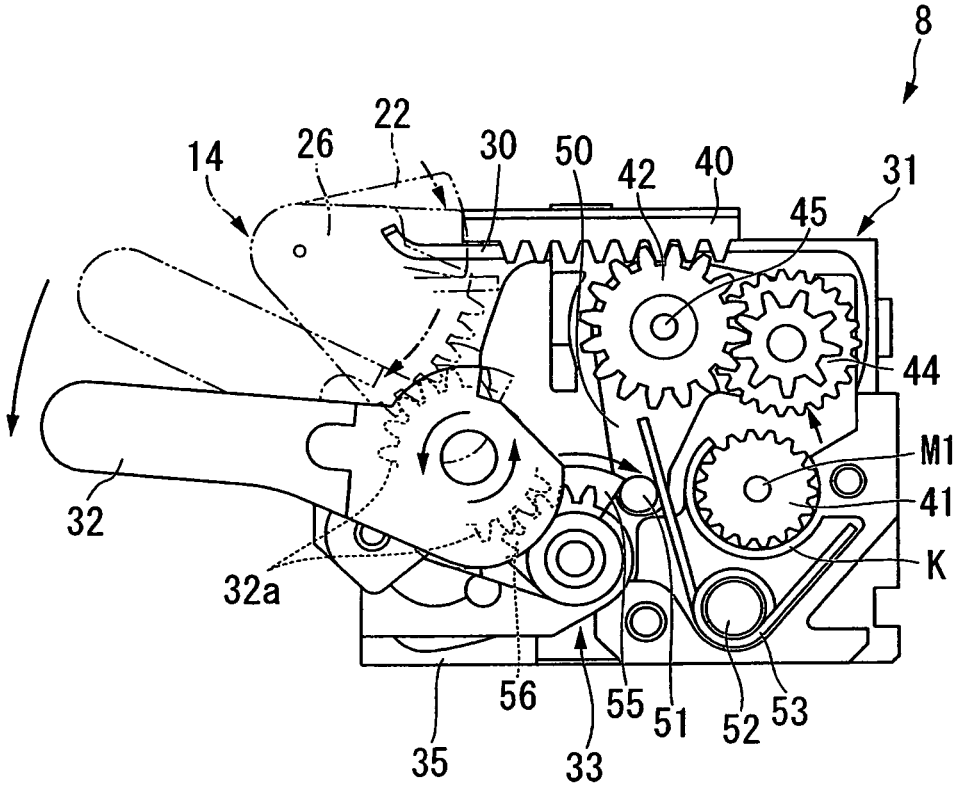
FIG. 22 is a view illustrating a state of pushing down the fixed blade by manipulating a lever portion from the state illustrated in FIG. 14, and releasing the bite of the fixed blade and the movable blade.

That is, in this case, the lever portion 32 arranged on the main unit 8 is first push-down operated from the outer side of the casing 2. The internal gear 32*a* of the lever portion 32 then rotates, as illustrated in FIG. 22, whereby the sector gear 26 on the platen unit 7 side rotates. When the sector gear 26 rotates, the shaft 23 and the two stoppers 22 rotate therewith. That is, the two stoppers 22 push down the cutting edge 11*a* side of the fixed blade 11 to the lower side in conjunction with the push-down operation of the lever portion 32, as illustrated in FIG. 21C. In other words, the cutting edge 11*a* of the fixed blade 11 is forcibly caused to swing by a force against the coil springs 13 so as to be away from the movable blade 30 riding on the upper surface. Thus, the contacting pressure of the movable blade 30 and the fixed blade 11, which is the cause of bite, can then be released.

If the contacting pressure is relatively high due to paper jam, the push-down amount of the stopper 22 can be adjusted according to the push-down extent of the lever portion 32, and thus the movement amount of the fixed blade 11 can be adjusted, and the contacting pressure of the blades 11 and 30 can be reliably released. In addition, since the stopper 22 is arranged at both ends of the fixed blade 11, both ends of the fixed blade 11 can be simultaneously moved to the lower side. Therefore, force can be evenly transmitted to both ends of the fixed blade 11, and the fixed blade 11 can be push-down moved without tilting. Therefore, the contacting pressure can be thus more reliably released.

Incidentally, when the lever portion 32 is push-down manipulated as described above, the sector gear 26 rotates by the rotation of the internal gear 32*a*, and at the same time, the release gear 56 also rotates, as illustrated in FIG. 22. The release plate 55 then rotates to the drive gear 41 side, thereby moving the pin 51 of the swinging plate 50 towards the drive gear 41 with the force against the torsion spring 53. The swinging plate 50 then rotates and moves the second gear 44 away from the drive gear 41. That is, the release mechanism 33 moves the second gear 44 geared with the drive gear 41 so as to be spaced away from the drive gear 41 in conjunction with the push-down operation of the lever portion 32. As illustrated in FIG. 21C and FIG. 22, the mechanical connection between the rack 40 and the drive gear 41 is then separated, and the movement regulation of the rack 40 is released to enter a free state.

Therefore, association with the motor for the cutter is eliminated, whereby the first gear 42 and the third gear 43 can be moved irrespective of the motor for the cutter. Thus, the pinion 57 rotates by the rotational biasing force by the coil spring 58, and the third gear 43 reverse rotates. The third gear 43 is coupled to the first gear 42 through an intermediation of the shaft 45, and thus the first gear 42 simultaneously reversely rotates as a result. In this case, the contacting pressure of the fixed blade 11 and the movable blade 30 is already released by the cooperative mechanism 14 on the platen unit 7 side, as described above, and hence the rack 40 moves by the reverse rotation of the first gear 42 and the third gear 43, and the movable blade 30 slidably moves to return to the predetermined position, as illustrated in FIG. 21C. That is, the movable blade 30 can automatically return to the predetermined position in a short period of time.

Figure 21D:
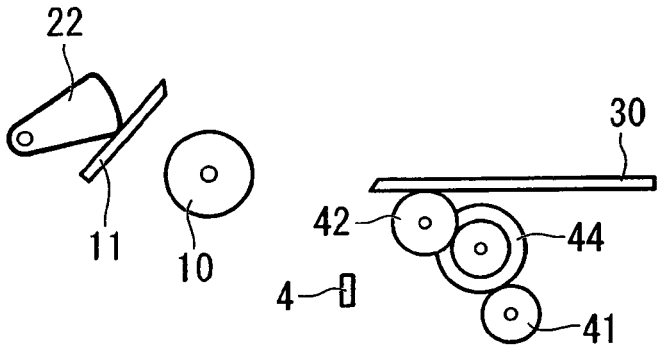

In this way, by push-down manipulating the lever portion 32, the contacting pressure of the fixed blade 11 and the movable blade 30 can be released with use of the stoppers 22, and the movable blade 30 can be automatically returned to the original position in a short period of time. Lastly, the lock mechanism is unlocked to open the open/close door 6. In this case, the lock shaft fitted to and locked with the lock groove 67 of the main unit 8 is also unlocked by the unlocking of the lock mechanism. Thus, when the open/close door 6 is opened, the bearing 10*a* of the platen roller 10 is detached from the fit-in hole 66 of the main unit 8, and the platen unit 7 separates from the main unit 8 as illustrated in FIG. 21D.

By thus opening the open/close door 6, it is possible to carry out appropriate response such as removing the jammed portion of the recording sheet P, which is the cause of bite. Then, by closing the open/close door 6 again, it is possible to combine and recover the platen unit 7 and the main unit 8, and the process can immediately proceed to the printing task.

As described above, the thermal printer 1 in this embodiment includes the cutter mechanism 3, and hence a high swinging property of the fixed blade 11 can be achieved. Accordingly, it is possible to reliably and entirely cut the recording sheet P from the both right and left sides thereof without leaving an uncut portion, etc. Therefore, a printer with a high degree of usability and improved reliability in terms of cutting performance can be provided.

Further, with a simple method of merely push-down manipulating the lever portion 32, the contacting pressure of the fixed blade 11 and the movable blade 30 is eliminated with use of the stoppers 22, and the bite can be released. Thus, the recovery task can be promptly carried out without imposing a burden on the operator. In addition, by forcibly pushing down the fixed blade 11 in the direction of moving away from the movable blade 30, the contacting pressure of the both blades 11 and 30 is eliminated and the bite is released. Therefore, even when the separation of the both units 7 and 8 is difficult due to paper jam, the bite can be reliably released. That is, the bite can be reliably released without being influenced by the state of paper jam.

In addition, with a simple method of merely push-down manipulating the lever portion 32, the gearing state of the rack 40 and the first gear 42 can be simultaneously released and the movable blade 30 can be automatically returned to the original position. Accordingly, the recovery task can be easily carried out even if paper jam occurs, and the printer with enhanced convenience can be obtained. In particular, the release of the contacting pressure of the fixed blade 11 and the movable blade 30, and the automatic withdrawing operation of the movable blade 30 can be simultaneously achieved with a one-touch operation of simply push-down manipulating the lever portion 32 without opening the open/close door 6.

Moreover, unlike a conventional fixed blade required to be provided with a projection-like support portion, the fixed blade 11 in this embodiment can be a simple plate-shaped fixed blade with the flat root portion 11*b*. Therefore, simplification of the shape of the fixed blade 11 can be achieved. In addition, a reduction in manufacturing cost of a die used to manufacture the fixed blade 11, a reduction in frequency of maintenance, and long lifetime of the die can be achieved.

Accordingly, the above-mentioned achievement can contribute to a reduction in cost of the fixed blade 11 and the cutter mechanism 3. Finally, the above-mentioned achievement can contribute to a reduction in cost of the thermal printer 1.

Note that the technical scope of the present invention is not limited to the above-mentioned embodiments, and various modifications may be made without departing from the gist of the present invention.

Figure 23:
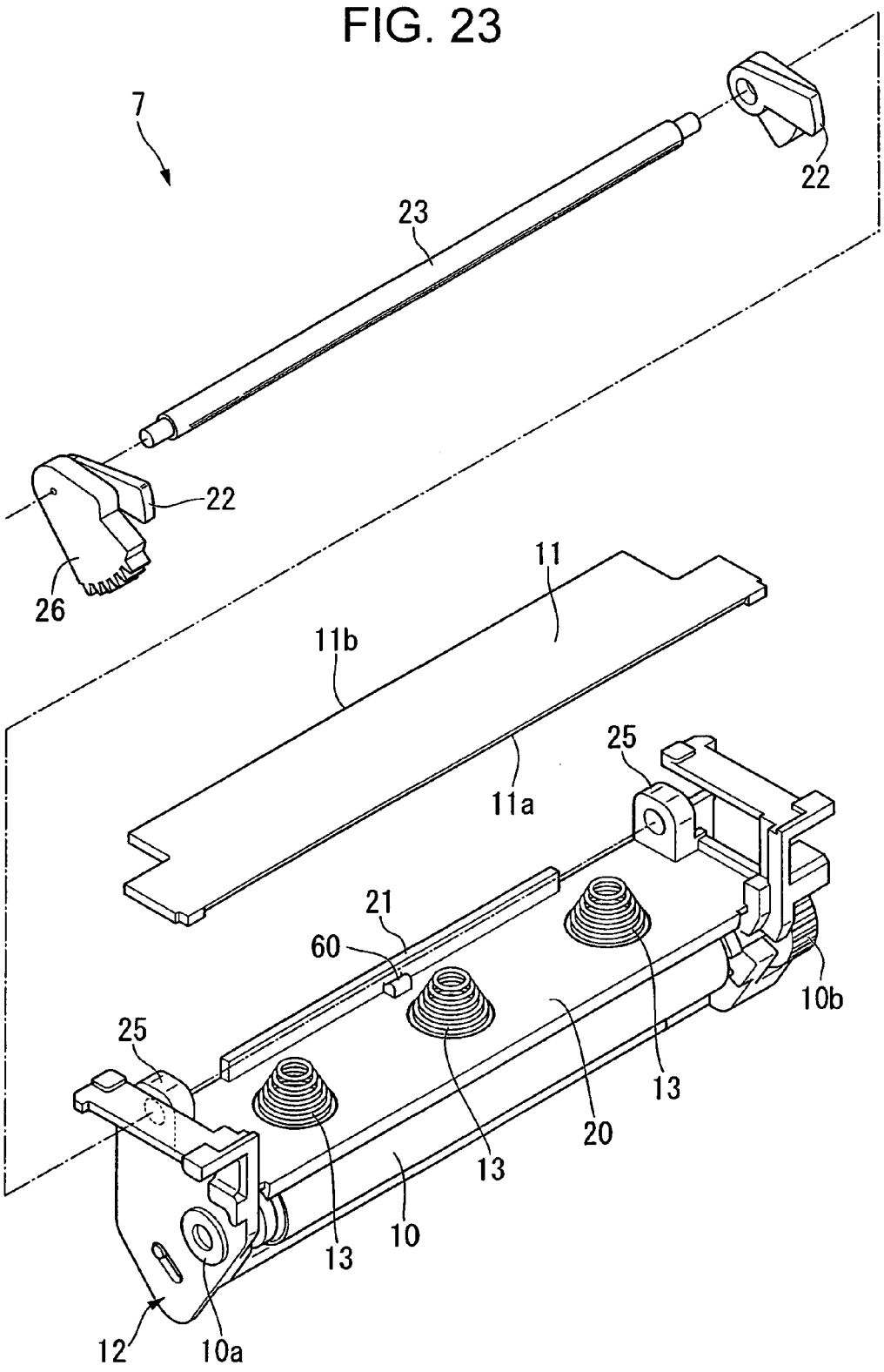
FIG. 23 is an exploded perspective view of the platen unit in which a projection-like protruding portion is formed on a base portion of a fixed blade holder, illustrating a modification example according to the present invention.
Figure 24:
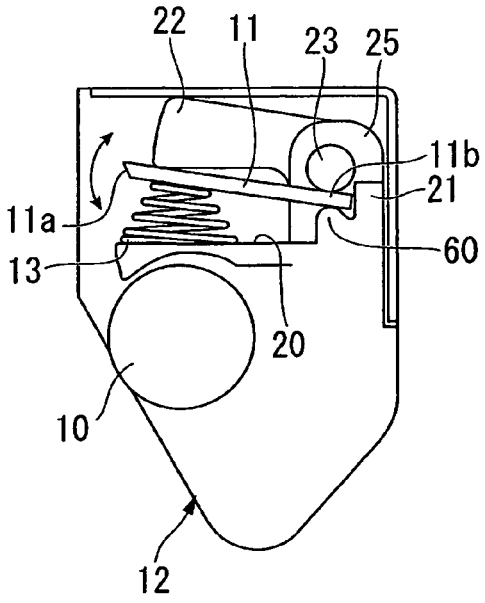
FIG. 24 is a cross-sectional view of the platen unit illustrated in FIG. 23.
Figure 25:
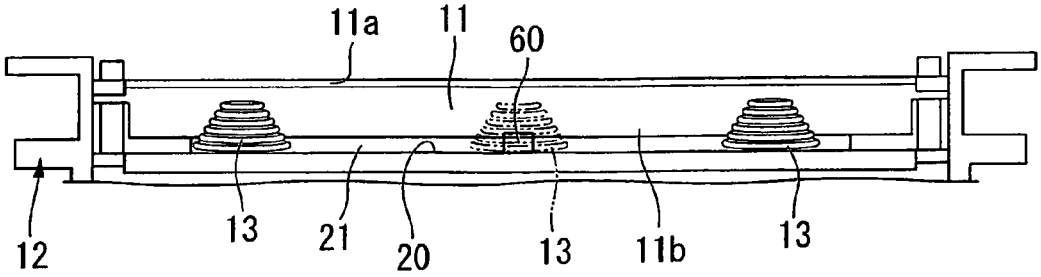
FIG. 25 is a view of the platen unit illustrated in FIG. 23 seen from the side of the cutting edge of the fixed blade.

For example, in the above-mentioned embodiment, as illustrated in FIG. 23 to FIG. 25, a projection-like protruding portion 60 may be formed on the base portion 20 of the fixed blade holder 12. The protruding portion 60 comes into contact with the root portion 11*b* at the substantially middle in the blade width direction of the fixed blade 11 to sandwich the root portion 11*b* with the shaft 23, and allows the fixed blade 11 to swing in the blade width direction with the contact portion acting as a fulcrum.

With this configuration, the fixed blade 11 is sandwiched between the protruding portion 60 and the shaft 23, and hence it is possible to prevent the fixed blade 11 from escaping so as to be pushed down toward the base portion 20 when the movable blade 30 rides on the fixed blade 11. Therefore, the cutting edge 11*a* of the fixed blade 11 can be brought into press-contact with the movable blade 30 more reliably, and a cutting property can be further increased.

In particular, the fixed blade 11 is allowed to swing like a seesaw in the blade width direction with the portion held in contact with the protruding portion 60 acting as a fulcrum. Accordingly, the fixed blade 11 is caused to swing according to circumstances during cutting from beginning to end, and the press-contact forces at the right and left two contact points can be equalized. Therefore, it is possible to reliably and entirely cut the recording sheet P from the both right and left sides thereof without leaving an uncut portion, etc.

Besides, the protruding portion 60 is formed at one point at the substantially middle in the blade width direction of the fixed blade 11, and hence it is possible to swing reliably and stably the entire fixed blade 11 ranging from both end portions to the middle thereof, and to obtain the above-mentioned operational effects.

Note that, instead of providing the protruding portion 60 on the base portion 20, a projecting portion corresponding to the protruding portion 60 may be provided on the lower surface side of the root portion 11*b* of the fixed blade 11. Even in this case, it is possible to obtain similar operational effects.

Figure 26:
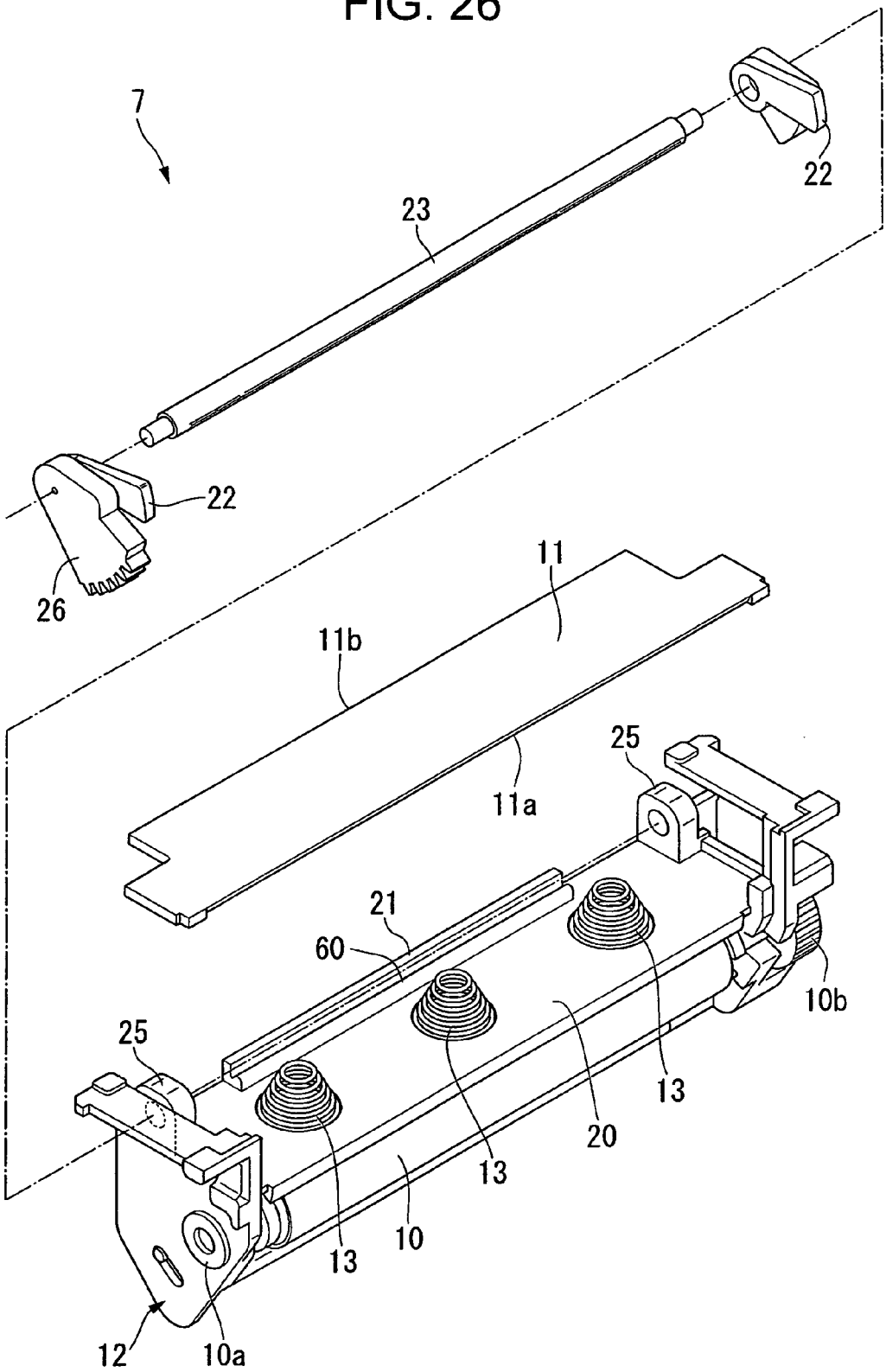
FIG. 26 is an exploded perspective view of the platen unit in which a bank-like protruding portion is formed on the base portion of the fixed blade holder, illustrating another modification example according to the present invention.

Further, as illustrated in FIG. 26, instead of the projection-like protruding portion, a bank-like protruding portion 60 may be formed to extend along the blade width direction of the fixed blade 11. Even in this case, it is possible to obtain similar operational effects. However, in a case of forming the bank-like protruding portion, a contact area between the root portion 11*b* of the fixed blade 11 and the protruding portion is larger when compared to a case of forming the projection-like protruding portion. Thus, the swinging property of the fixed blade 11 is slightly lowered. Therefore, it is preferred that the projection-like protruding portion be formed in a case of forming the protruding portion 60.

For instance, in each embodiment described above, the thermal printer has been described as one example of the printer with a cutter, but it is not limited to the thermal printer. For instance, it may be an inkjet printer having a printing portion as the inkjet head, for printing on the recording sheet using ink droplets.

While the thermal printer having the open/close door on the upper surface of the casing has been described in the above embodiments, the design may be made such that the open/close door is arranged to the front surface of the casing, and hence the printed recording sheet is discharged from the front surface side. A drop-in type thermal printer of simply placing the paper roll and mounting it on the mounting board has been described, but it is not limited to such type, and may be an axial-supporting type thermal printer in which an axially supporting mechanism for axially supporting (rotatably supporting) the paper roll is arranged in the interior of the casing.

Further, in the above-mentioned embodiment, the platen unit incorporating the fixed blade is provided on the open/close door side, and the main unit incorporating the movable blade is provided on the casing side. Contrary thereto, the platen unit may be provided on the casing side, and the main unit may be provided on the open/close door side.

Moreover, the fixed blade may be provided on the main unit side, and the movable blade may be provided on the platen unit side. That is, each of the fixed blade and the movable blade may be provided to any one of the main unit and the platen unit, and appropriate selection may be made according to design of the printer.

Further, in the above-mentioned embodiment, there is exemplified a thermal printer of a type in which the main unit and the platen unit are separated in accordance with the opening/closing of the open/close door. Depending thereon, there is described a cutter mechanism of a separation type in which the fixed blade and the movable blade separate. However, the cutter mechanism may be employed in a thermal printer of a type in which the main unit and the platen unit do not separate. In this case, there may be adopted a cutter mechanism of an integral type in which the fixed blade and the movable blade do not separate. Even in this case, it is possible to achieve a main object of the present invention to enable the high swinging property of the fixed blade, and to reliably and entirely cut the recording sheet from the both right and left sides thereof without leaving an uncut portion, etc.

Further, in the above-mentioned embodiment, the thermal printer integrally incorporating the cutter mechanism is exemplified. However, there may be adopted a configuration in which only the cutter mechanism is separable.

Further, in the above-mentioned embodiment, the movable blade is arranged on the downstream side of the fixed blade, and is configured so as to ride on the upper surface of the fixed blade. However, even in a case where the cutter mechanism is of any one of the separation type and the integral type, the movable blade may be arranged on the upstream side of the fixed blade. In any case, regarding the positional relationship between the fixed blade and the movable blade, the fixed blade may be provided on any one of the upstream side and the downstream side of the movable blade, or the movable blade may be provided on any one of the upstream side and the downstream side of the fixed blade.

Moreover, in the above-mentioned embodiment, the lifting of the cutting edge of the fixed blade is regulated with use of the stoppers, and the lifting of the root portion of the fixed blade is regulated with use of the shaft. However, the first regulating member and the second regulating member are not limited to the stoppers and the shaft, respectively. A claw portion, a projecting portion, a wall portion, etc. is merely formed on the fixed blade holder, and may be used to regulate the lifting of the cutting edge and the lifting of the root portion.

What is claimed is:

1. A cutter mechanism for cutting a recording sheet, the cutter mechanism comprising:

a fixed blade formed into a plate shape and having opposite ends and two parallel sides, one of the two parallel sides serving as a cutting edge and the other of the two parallel sides serving as a root portion;

a movable blade substantially V-shaped in top view, the movable blade being slidably arranged with respect to the fixed blade and configured to ride on the fixed blade during sliding to cut the recording sheet while the recording sheet is located between the fixed blade and the movable blade;

a biasing member mounted on a base portion for biasing the fixed blade in a direction away from the base portion; and a fixed blade holder supporting the fixed blade at a position away from the base portion so as to cause the cutting edge to swing up and down about the root portion and so as to permit the opposite ends of the fixed blade to be pushed down at least in the direction of the base portion, the fixed blade holder having a wall portion protruding from the base portion for positioning the fixed blade in a sliding direction of the movable blade by coming into contact with the root portion of the fixed blade, a first regulating member configured to regulate lifting of the cutting edge of the biased fixed blade, and a second regulating member configured to regulate lifting of the root portion of the biased fixed blade in a state in which a predetermined gap is formed between the base portion and the root portion of the fixed blade.

2. A cutter mechanism according to claim 1; wherein the base portion has a protruding portion configured to come into contact with the root portion at a substantial center in a blade width direction of the fixed blade so as to sandwich the root portion with the second regulating member, and to allow the fixed blade to swing in the blade width direction with a portion of the fixed blade held in contact with the protruding portion acting as a fulcrum.

3. A cutter mechanism according to claim 1; wherein the first regulating member is configured to allow the fixed blade to move in a direction away from the movable blade so as to release a contacting pressure between the fixed blade and the movable blade.

4. A cutter mechanism according to claim 1; further comprising: a first unit incorporating the fixed blade, the fixed blade holder and the biasing member; and a second unit incorporating the movable blade and being separably combined with the first unit; wherein one of the first unit and the second unit is releasably attached to the other of the first unit and the second unit.

5. A printer with a cutter, comprising: a cutter mechanism according to claim 1; and a printing portion for performing printing on the recording sheet.

6. A printer with a cutter according to claim 5; wherein the base portion of the cutter mechanism has a protruding portion configured to come into contact with the root portion at a substantial center in a blade width direction of the fixed blade so as to sandwich the root portion with the second regulating member, and to allow the fixed blade to swing in the blade width direction with a portion of the fixed blade held in contact with the protruding portion acting as a fulcrum.

7. A printer with a cutter according to claim 5; wherein the first regulating member of the cutter mechanism is configured to allow the fixed blade to move in a direction away from the movable blade so as to release a contacting pressure between the fixed blade and the movable blade.

8. A printer with a cutter according to claim 5; wherein the cutter mechanism further comprises: a first unit incorporating the fixed blade, the fixed blade holder and the biasing member; and a second unit incorporating the movable blade and being separably combined with the first unit; wherein one of the first unit and the second unit is releasably attached to the other of the first unit and the second unit.

9. A cutter mechanism for cutting a recording sheet, the cutter mechanism comprising:

a fixed blade having opposite ends and first and second sides between the opposite ends, the first side serving as a cutting edge and the second side serving as a root portion of the fixed blade;

a movable blade mounted for undergoing sliding movement relative to the fixed blade and for cooperating with the fixed blade to cut a recording sheet located between the fixed blade and the movable blade during sliding movement of the movable blade;

a biasing member mounted on a base portion for biasing the fixed blade in a direction away from the base portion; and a fixed blade holder supporting the fixed blade at a position away from the base portion so as to cause the cutting edge of the fixed blade to swing up and down and to permit the opposite ends of the fixed blade to be pushed down at least in the direction of the base portion, the fixed blade holder having a wall portion protruding from the base portion for positioning the fixed blade in a sliding direction of the movable blade by coming into contact with the root portion of the fixed blade, a first regulating member configured to regulate lifting of the cutting edge of the biased fixed blade, and a second regulating member configured to regulate lifting of the root portion of the biased fixed blade in a state in which a predetermined gap is formed between the base portion and the root portion of the fixed blade.

10. A cutter mechanism according to claim 9; wherein the base portion has a protruding portion configured to come into contact with the root portion of the fixed blade at a substantial center in a blade width direction of the fixed blade so as to sandwich the root portion with the second regulating member, and to allow the fixed blade to swing in the blade width direction with a portion of the fixed blade held in contact with the protruding portion acting as a fulcrum.

11. A cutter mechanism according to claim 9; wherein the first regulating member is configured to allow the fixed blade to move in a direction away from the movable blade so as to release a contacting pressure between the fixed blade and the movable blade.

12. A cutter mechanism according to claim 9; further comprising: a first unit incorporating the fixed blade, the fixed blade holder and the biasing member; and a second unit incorporating the movable blade and being separably combined with the first unit; wherein one of the first unit and the second unit is releasably attached to the other of the first unit and the second unit.

13. A cutter mechanism according to claim 9; wherein the fixed blade holder supports the fixed blade at a position away from the base portion so as to cause the cutting edge to swing up and down about the root portion in a direction substantially orthogonal to the sliding direction of the movable blade.

14. A printer with a cutter, comprising: a cutter mechanism according to claim 9; and a printing portion for performing printing on the recording sheet.

15. A printer with a cutter according to claim 14; wherein the base portion of the cutter mechanism has a protruding portion configured to come into contact with the root portion at a substantial center in a blade width direction of the fixed blade so as to sandwich the root portion with the second regulating member, and to allow the fixed blade to swing in the blade width direction with a portion of the fixed blade held in contact with the protruding portion acting as a fulcrum.

16. A printer with a cutter according to claim 15; wherein the first regulating member is configured to allow the fixed blade to move in a direction away from the movable blade so as to release a contacting pressure between the fixed blade and the movable blade.

17. A printer with a cutter according to claim 14; wherein the cutter mechanism further comprises: a first unit incorporating the fixed blade, the fixed blade holder and the biasing member of the cutter mechanism; and a second unit incorporating the movable blade of the cutter mechanism and being separably combined with the first unit; wherein one of the first unit and the second unit is releasably attached to the other of the first unit and the second unit.

18. A printer with a cutter according to claim 14; wherein the fixed blade holder of the cutter mechanism supports the fixed blade at a position away from the base portion so as to cause the cutting edge to swing up and down about the root portion in a direction substantially orthogonal to sliding direction of the movable blade.

* * * * *